United States Patent [19]

Yoshihara et al.

[11] Patent Number: 4,716,091

[45] Date of Patent: Dec. 29, 1987

[54] ELECTROPHOTOGRAPHIC MEMBER WITH SILICONE GRAFT COPOLYMER IN SURFACE LAYER

[75] Inventors: Toshiyuki Yoshihara, Mitaka; Masaaki Hiro, Kanagawa; Katsunori Watanabe, Yamato, all of Japan

[73] Assignee: Canon Kabushiki Kaisha, Tokyo, Japan

[21] Appl. No.: 829,935

[22] Filed: Feb. 18, 1986

[30] Foreign Application Priority Data

| | | | |
|---|---|---|---|
| Feb. 19, 1985 | [JP] | Japan | 60-29424 |
| Sep. 27, 1985 | [JP] | Japan | 60-215494 |
| Sep. 27, 1985 | [JP] | Japan | 60-215495 |
| Sep. 27, 1985 | [JP] | Japan | 60-215497 |

[51] Int. Cl.[4] ..... G03G 5/14

[52] U.S. Cl. ..... 430/66; 430/67; 430/96

[58] Field of Search ..... 430/66, 96, 67

[56] References Cited

U.S. PATENT DOCUMENTS

| | | | |
|---|---|---|---|
| 4,263,388 | 4/1981 | Schank et al. | 430/96 |
| 4,275,133 | 6/1981 | Chu et al. | 430/96 |
| 4,510,227 | 4/1985 | Mohr et al. | 430/96 |
| 4,600,673 | 7/1986 | Hendrickson et al. | 430/66 |

*Primary Examiner*—John L. Goodrow

*Attorney, Agent, or Firm*—Fitzpatrick, Cella, Harper & Scinto

[57] ABSTRACT

An image holding member has a surface layer containing a silicone type comb shaped graft polymer having a silicone portion at the side chain.

12 Claims, No Drawings

ELECTROPHOTOGRAPHIC MEMBER WITH SILICONE GRAFT COPOLYMER IN SURFACE LAYER

BACKGROUND OF THE INVENTION

1. Field of the Invention

This invention relates to an image holding member for holding electrostatic images or toner images, and more particularly, to an image holding member of excellent durability, cleaning property and the like containing graft polymers in the surface layer.

2. Description of the Related Art

Electrostatic images or toner images are formed by various electrophotographic processes. As an image holding member bearing the produced images, there are image holding members having a photoconductive layer, so-called "electrophotographic photosensitive member", and those having no photoconductive layers.

An electrophotographic photosensitive member may have various embodiments depending on the type of electrophotographic process. Representative electrophotographic photosensitive members are a photosensitive member constituted of a support and a photoconductive layer overlying the support and a photosensitive member having an image holding member constituted of a photoconductive layer and an insulating layer. These are widely used.

Electrophotographic photosensitive members are subjected to a predetermined electrophotographic process to form electrostatic images and visualize the electrostatic images by developing. The surface layer of the image holding member is subjected to various treatments, for example, electrical and mechanical treatments such as charging, exposure, development, transferring, cleaning and the like. Therefore, it is necessary for repeated use of a photosensitive member that the surface layer exhibits a high durability to such treatments. In particular, durability against surface damages is very important. On the other hand, remaining toner particles after transferring, paper powders of receiving papers, and decomposition products formed by ozone generated by corona charging are attached to the surface layer. There fore, when the cleaning treatment is insufficient, the remaining toner particles are fused and adhered to the surface layer and the surface resistance is lowered resulting in degradation of image quality. Therefore, for the purpose of satisfying the need for repeated durability, the surface layer of the image holding member is required to have a good cleaning property.

Heretofore, it has been attempted to add a material capable of imparting a lubricating property to the surface layer for satisfying the above-mentioned properties. Examples of the material are ordinary coating film surface modifying agents such as leveling agents, silicone oils and the like. As another method, Teflon powders may be dispersed. However, ordinary surface modifying agents have poor compatibility with components of a liquid coating material to be added so that the surface modifier is transferred to or exudes from the surface layer during use for a long period of time. As a result, the duration of effect of the surface modifier is problematic. In addition, when the surface layer itself forms a photoconductive layer, the surface modifying agent is not compatible with a photoconductive material and is liable to become a trap to movement of carriers generated by light. Therefore, there is a tendency that the residual charge increases during repeating electrophotographic processing. On the other hand, in case of a surface layer in which Teflon powders are dispersed, there are problems such as poor dispersability, lowered transparency, trapping carriers and the like.

SUMMARY OF THE INVENTION

An object of the present invention is to provide an image holding member having a transparent surface layer of good surface lubricating property, releasing property and cleaning property.

Another object of the present invention is to provide an image holding member of high repeating durability and less damage of the surface layer.

A further object of the present invention is to provide an image holding member free from accumulation of residual charge and providing consistently images of high quality in electrophotographic processes.

According to the present invention, there is provided an image holding member which comprises a surface layer containing a silicone type comb shaped graft polymer having a silicone portion at the side chain.

The graft polymer according to the present invention is highly compatible with general resins so that the graft polymer can be stably maintained in the surface layer of the image holding member. Since the graft polymer has a good property of migration to the surface, then excellent surface durability, cleaning property and the like of the image holding member can be retained. Transferring of light carriers is not disturbed so that accumulation of residual charge is not caused even if the electrophotographic process is repeated, and therefore, a stable charging property is obtained.

DESCRIPTION OF THE PREFERRED EMBODIMENT

The preferred constitution of a silicone type comb shaped graft polymer according to the present invention is that produced by copolymerization of a compound having a copolymerizable functional group with a modified silicone which is a condensation reaction product of a silicone selected from the following formulas (I) and (II) and a solicone selected from the following formulas (III), (IV) and (V).

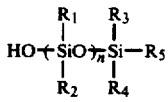

(I)

when $R_1$–$R_5$ are selected from alkyl and aryl, and n is an average degree of polymerization.

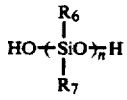

(II)

where $R_6$ and $R_7$ are selected from alkyl and aryl, and n is an average degree of polymerization.

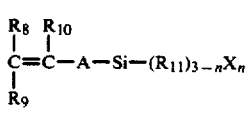

(III)

where $R_8$, $R_9$ and $R_{10}$ are selected from hydrogen, halogen, alkyl and aryl, $R_{11}$ is selected from alkyl and aryl, A is arylene, X is selected from halogen and alkoxy, and n is an integer of 1-3.

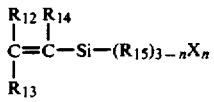

(IV)

where $R_{12}$, $R_{13}$, and $R_{14}$ are selected from hydrogen, halogen, alkyl and aryl, $R_{15}$ is selected from alkyl and aryl, X is selected from halogen and alkoxy, and n is an integer of 1-3.

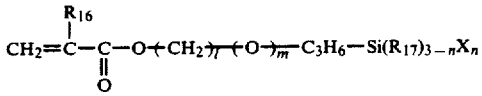

(V)

where $R_{16}$ is selected from hydrogen, alkyl, aryl and aralkyl, $R_{17}$ is selected from alkyl and aryl, X is selected from halogen and alkoxy, m is 0 or 1, 1 is an integer of 0-2 when m=0, 1 is 2 when m=1, and n is an integer of 1-3.

The silicone type comb shaped graft polymer used in the present invention has a structure such that side chains containing silicone hang down from the main chain in a form of branch.

In the general formulas (I) and (II) above, $R_1$, $R_2$, $R_3$, $R_4$, $R_5$, $R_6$ and $R_7$ are selected from alkyl and aryl which may be substituted. For example, the alkyl may be methyl, ethyl, propyl, butyl, and the like, and they may be substituted with a halogen atom or the like. As aryl, there may be mentioned phenyl, naphthyl and the like, and they may have a substituent. Methyl and phenyl are preferred, n stands for an average degree of polymerization, and n is preferably 1-1000, particularly 10-500.

In the general formula (III), $R_8$, $R_9$, and $R_{10}$ are selected from hydrogen, halogen such as fluorine, chlorine, bromine and iodine, alkyl, aryl, and alkyl and aryl may be substituted. As alkyl, there may be mentioned methyl, ethyl, propyl, butyl and the like. As aryl, there may be mentioned phenyl, naphthyl, and the like. Hydrogen is preferred.

$R_{11}$ is alkyl such as methyl, ethyl, propyl, butyl and the like, and alkyl may have halo as a substituent, or aryl such as phenyl, naphthyl and the like which may be substituted. Methyl and phenyl are preferred.

X is halogen such as fluorine, chlorine, bromine and iodine, preferably, chlorine, or alkoxy such as methoxy, ethoxy, propoxy, butoxy and the like, which may have a substituent.

Methoxy, ethoxy, and 2-methoxy-ethoxy are preferable. A is arylene such as phenylene, biphenylene, naphthylene and the like which may be substituted, and n is an integer of 1-3. Silicone species selected from (III)-(V) may be one or more.

Examples of general formulas (I)-(V) are as shown below:

| No. | |
|---|---|
| | Examples of General Formula (I) |
| 1. | 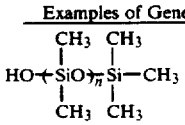 |

-continued

| No. | |
|---|---|
| 2. | 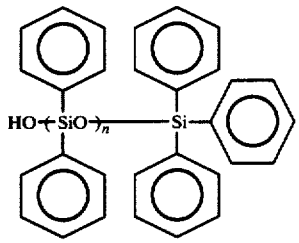 |
| 3. | 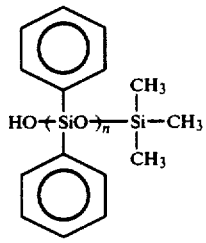 |
| 4. | 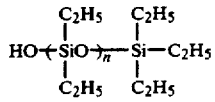 |
| 5. | 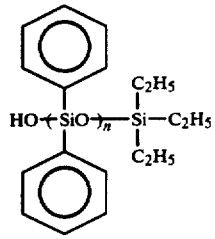 |
| 6. | 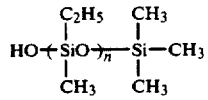 |
| 7. | 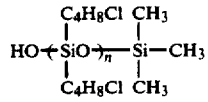 |
| 8. | 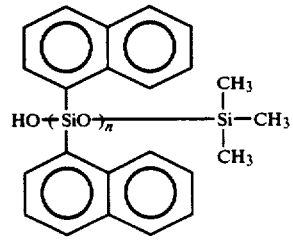 |

-continued
No.
9.
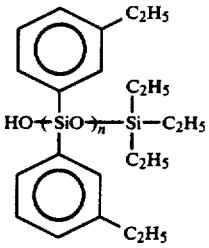
10.
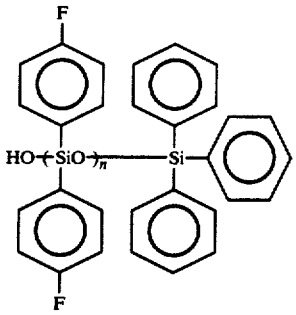
11.
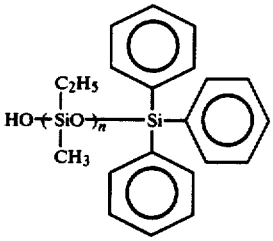
12.
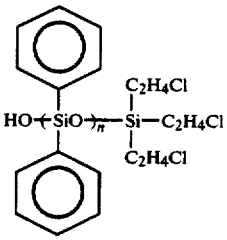
13.
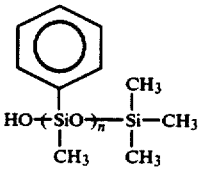
14.
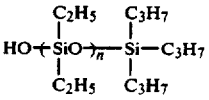
-continued
No.
15.
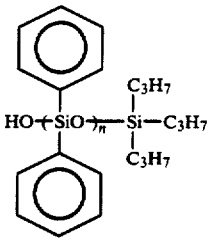
16.
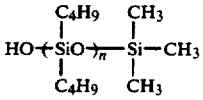
17.
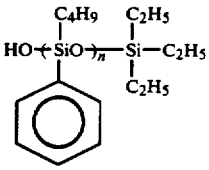
18.
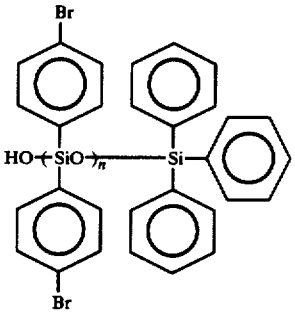
19.
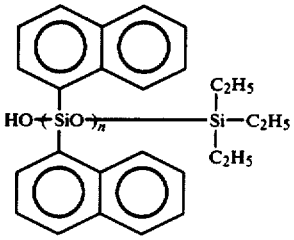
20.
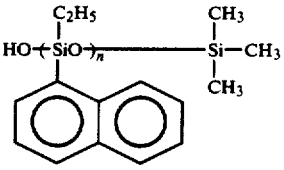
21.
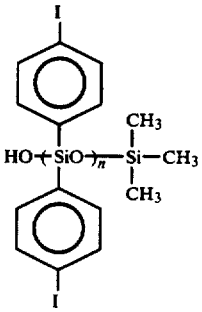

-continued
No.
22.
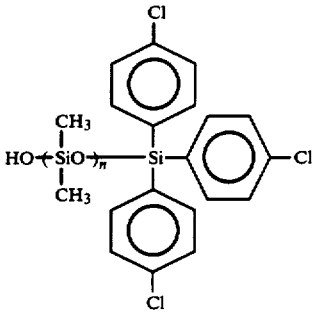
23.
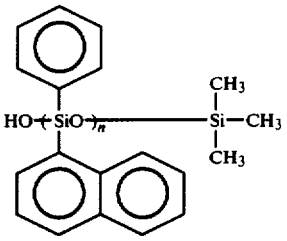
24.
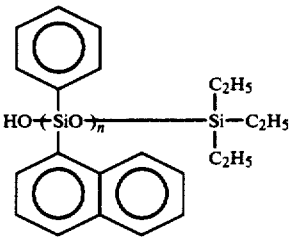
25.
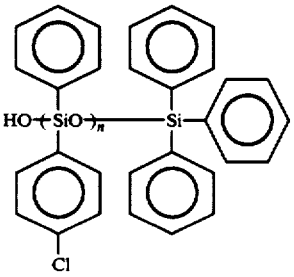
Examples of General Formula (II)
26.
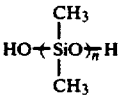
27.
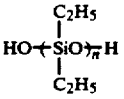
28.
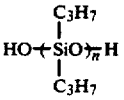
29.
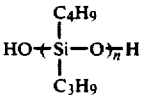
-continued
No.
30.
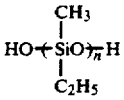
31.
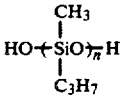
32.
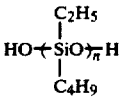
33.
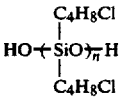
34.
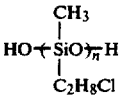
35.
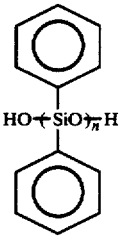
36.
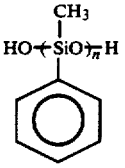
37.
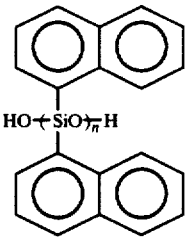
38.
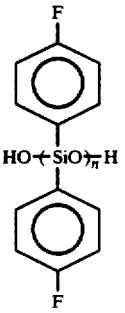

-continued
No.
39.
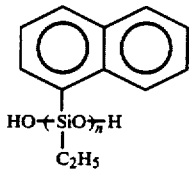
40.
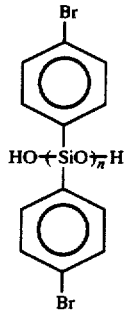
41.
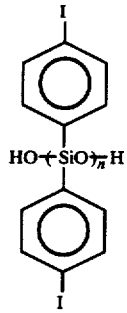
42.
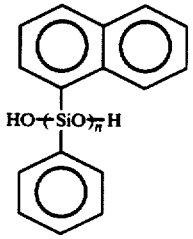
Examples of General Formula (III)
43.
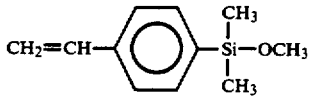
44.
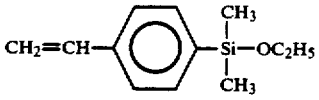
45.
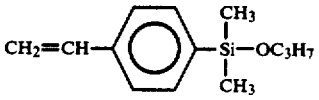
46.
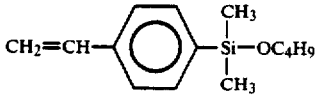
-continued
No.
47.
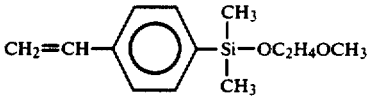
48.
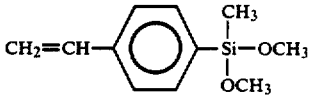
49.
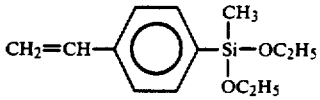
50.
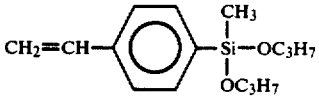
51.
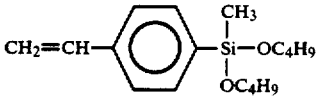
52.
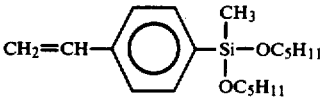
53.
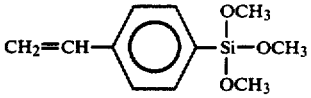
54.
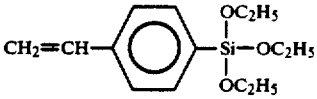
55.
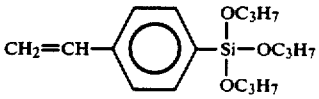
56.
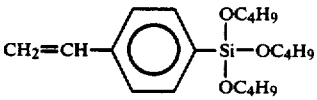
57.
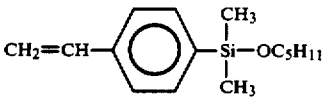
58.
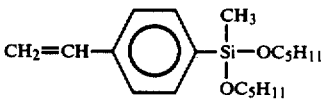
59.
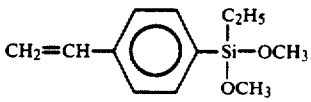

-continued
No.
60.
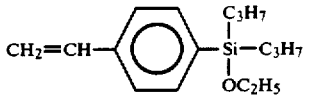
61.
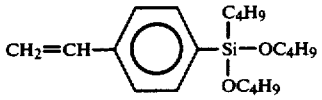
62.
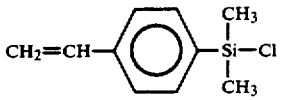
63.
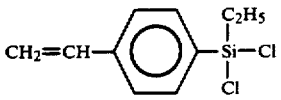
64.
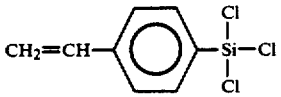
65.
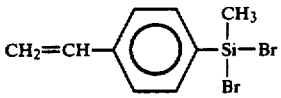
66.
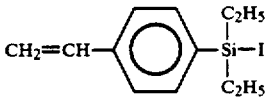
67.
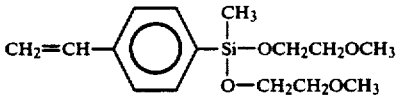
68.
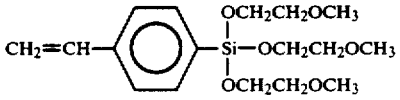
69.
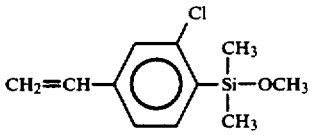
70.
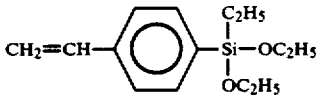
71.
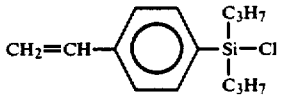
72.
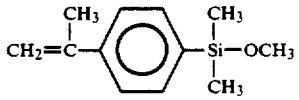
-continued
No.
73.
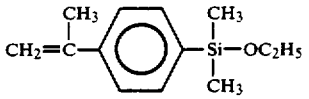
74.
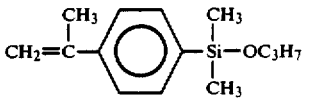
75.
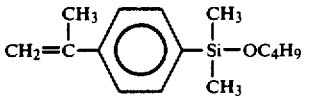
76.
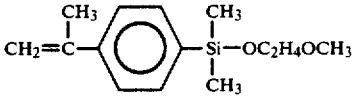
77.
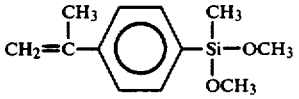
78.
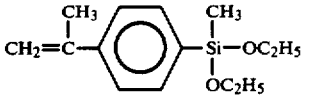
79.
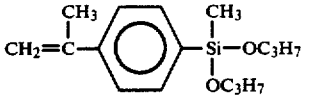
80.
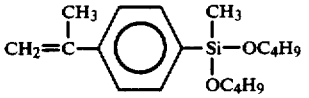
81.
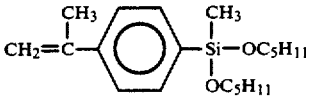
82.
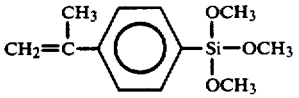
83.
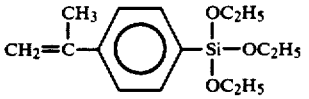
84.
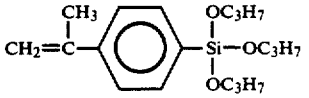
85.
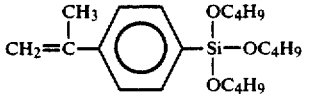

-continued
No.
86.
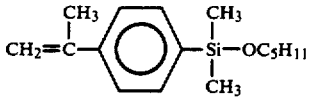
87.
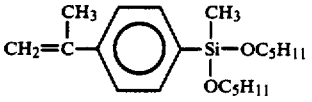
88.
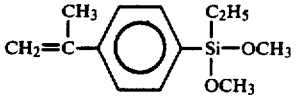
89.
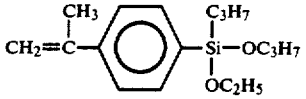
90.
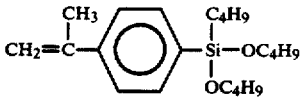
91.
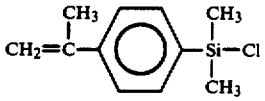
92.
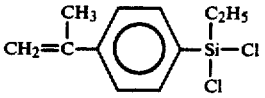
93.
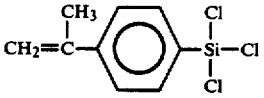
94.
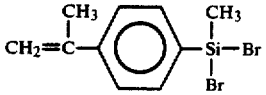
95.
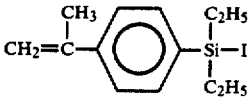
96.
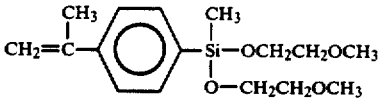
97.
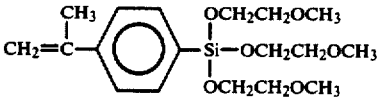
98.
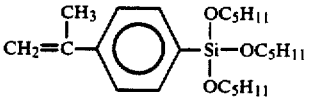
-continued
No.
99.
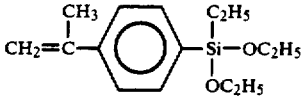
100.
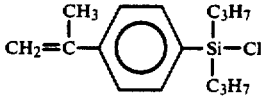
101.
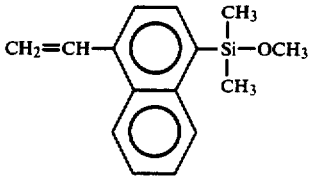
102.
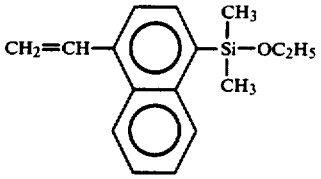
103.
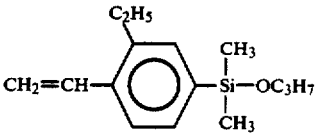
104.
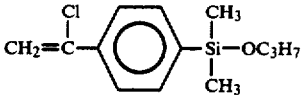
105.
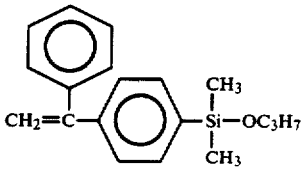
106.
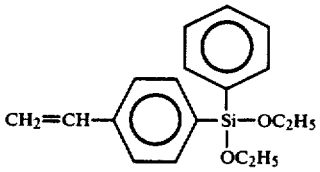
107.
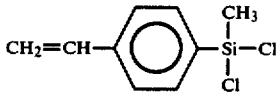
108.
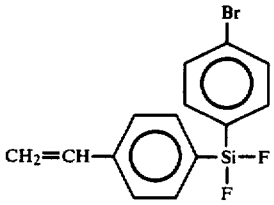

-continued
No.
109.
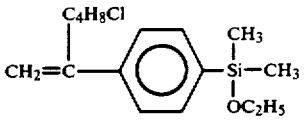
110.
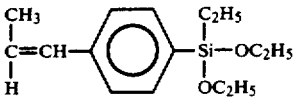
111.
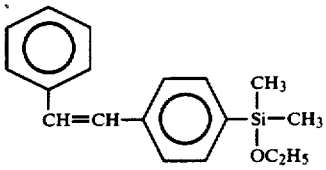
Examples of General Formula (IV)
112.
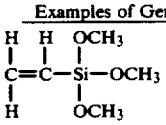
113.
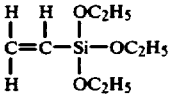
114.
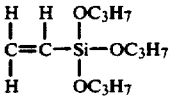
115.
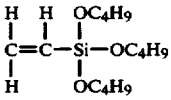
116.
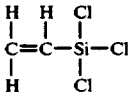
117.
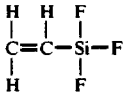
118.
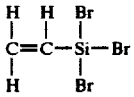
119.
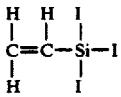
120.
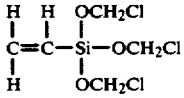
121.
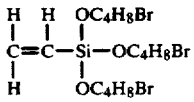
-continued
No.
122.
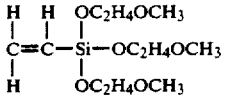
123.
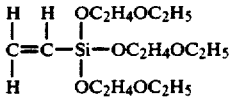
124.
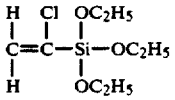
125.
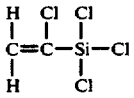
126.
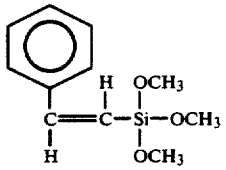
127.
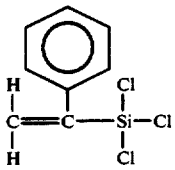
128.
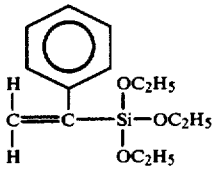
129.
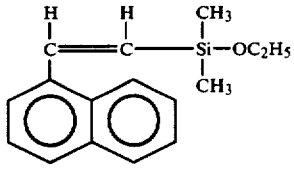
130.
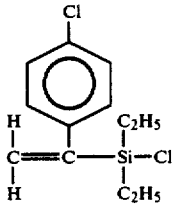
131.
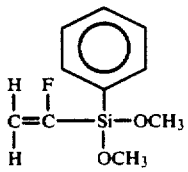

-continued
No.
132.
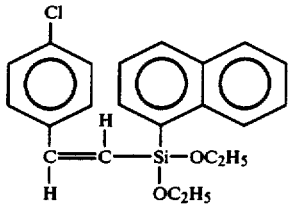
133.
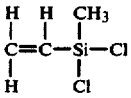
134.
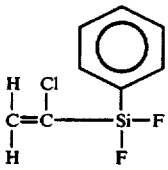
135.
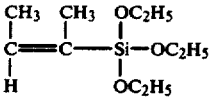
136.
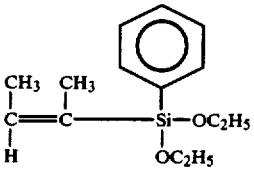
137.
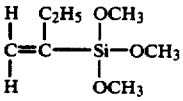
138.
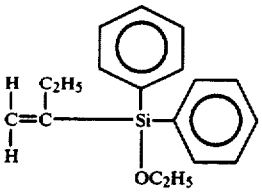
139.
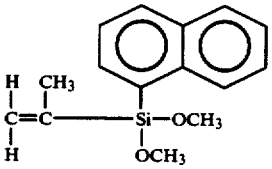
140.
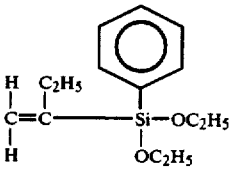
-continued
No.
141.
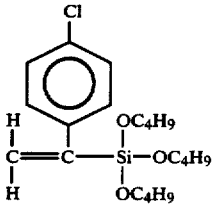
142.
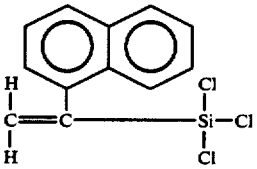
143.
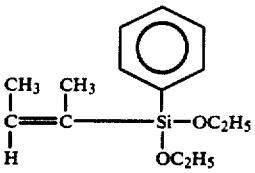
144.
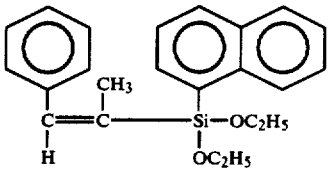
145.
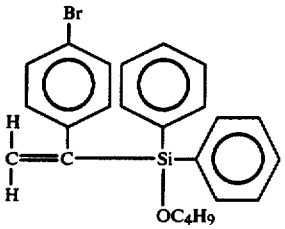
146.
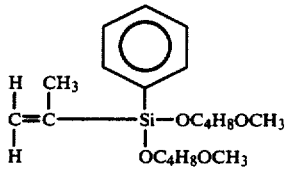
147.
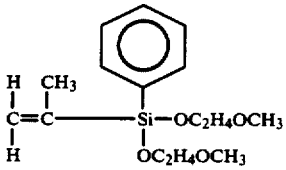
148.
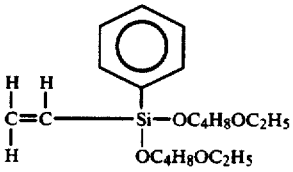

-continued
No.
150.
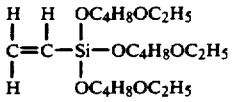
151.
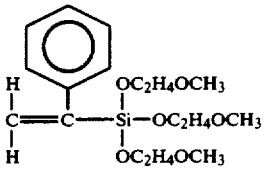
152.
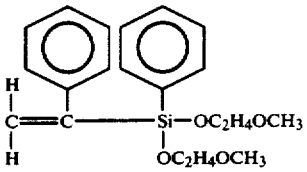
153.
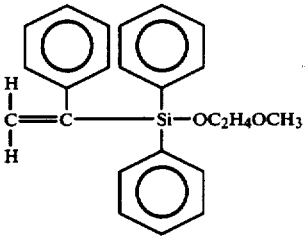
Examples of General Formula (V)
154.
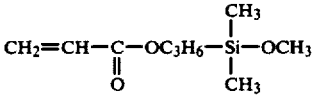
155.
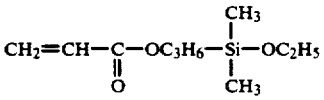
156.
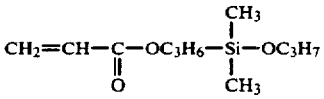
157.
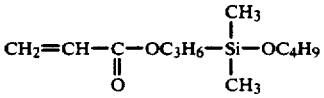
158.
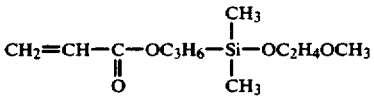
159.
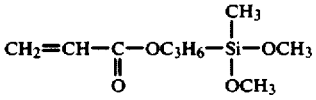
160.
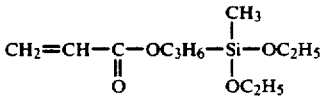
-continued
No.
161.
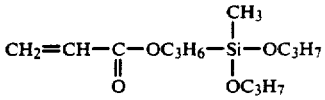
162.
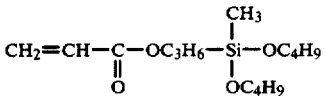
163.
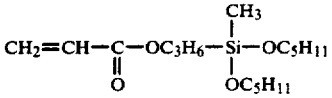
164.
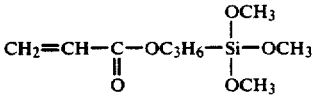
165.
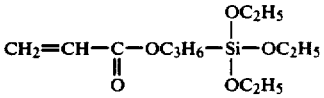
166.
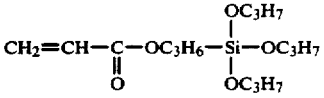
167.
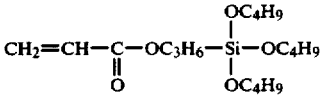
168.
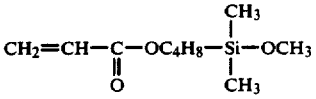
169.
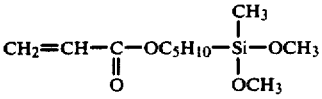
170.
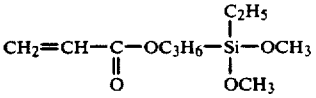
171.
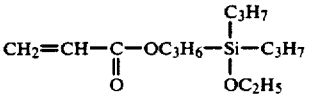
172.
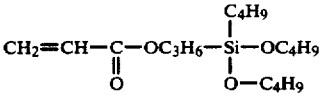
173.
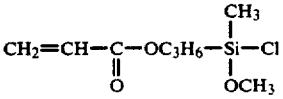
174.
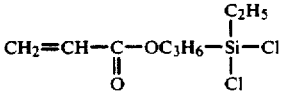

-continued

| No. | |
|---|---|
| 175. | $CH_2{=}CH{-}\underset{\underset{O}{\|}}{C}{-}OC_3H_6{-}\overset{\overset{Cl}{\|}}{\underset{\underset{Cl}{\|}}{Si}}{-}Cl$ |
| 176. | $CH_2{=}CH{-}\underset{\underset{O}{\|}}{C}{-}OC_3H_6{-}\overset{\overset{CH_3}{\|}}{\underset{\underset{Br}{\|}}{Si}}{-}Br$ |
| 177. | $CH_2{=}CH{-}\underset{\underset{O}{\|}}{C}{-}OC_5H_{10}{-}\overset{\overset{C_2H_5}{\|}}{\underset{\underset{C_2H_5}{\|}}{Si}}{-}I$ |
| 178. | $CH_2{=}CH{-}\underset{\underset{O}{\|}}{C}{-}OC_3H_6{-}\overset{\overset{CH_3}{\|}}{\underset{\underset{O{-}CH_2CH_2OCH_3}{\|}}{Si}}{-}OCH_2CH_2OCH_3$ |
| 179. | $CH_2{=}CH{-}\underset{\underset{O}{\|}}{C}{-}OC_4H_8{-}\overset{\overset{OCH_2CH_2OCH_3}{\|}}{\underset{\underset{OCH_2CH_2OCH_3}{\|}}{Si}}{-}OCH_2CH_2OCH_3$ |
| 180. | $CH_2{=}CH{-}\underset{\underset{O}{\|}}{C}{-}OC_2H_4OC_3H_6{-}\overset{\overset{CH_3}{\|}}{\underset{\underset{CH_3}{\|}}{Si}}{-}OCH_3$ |
| 181. | $CH_2{=}CH{-}\underset{\underset{O}{\|}}{C}{-}OC_2H_4OC_3H_6{-}\overset{\overset{C_2H_5}{\|}}{\underset{\underset{OC_2H_5}{\|}}{Si}}{-}OC_2H_5$ |
| 182. | $CH_2{=}CH{-}\underset{\underset{O}{\|}}{C}{-}OC_2H_4OC_3H_6{-}\overset{\overset{C_3H_7}{\|}}{\underset{\underset{C_3H_7}{\|}}{Si}}{-}Cl$ |
| 183. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}OCH_3$ |
| 184. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}OC_2H_5$ |
| 185. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}OC_3H_7$ |
| 186. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}OC_4H_9$ |
| 187. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}OC_2H_4OCH_3$ |
| 188. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{OCH_3}{\|}}{Si}}{-}OCH_3$ |

-continued

| No. | |
|---|---|
| 189. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{OC_2H_5}{\|}}{Si}}{-}OC_2H_5$ |
| 190. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{OC_3H_7}{\|}}{Si}}{-}OC_3H_7$ |
| 191. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{OC_3H_7}{\|}}{Si}}{-}OC_3H_7$ |
| 192. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{OC_4H_9}{\|}}{Si}}{-}OC_4H_9$ |
| 193. | $CH_2{=}\overset{\overset{CH_3}{\|}}{C}{-}\underset{\underset{O}{\|}}{C}{-}OC_3H_6{-}\overset{\overset{OCH_3}{\|}}{\underset{\underset{OCH_3}{\|}}{Si}}{-}OCH_3$ |
| 194. | $CH_2{=}\overset{\overset{CH_3}{\|}}{C}{-}\underset{\underset{O}{\|}}{C}{-}OC_3H_6{-}\overset{\overset{OC_2H_5}{\|}}{\underset{\underset{OC_2H_5}{\|}}{Si}}{-}OC_2H_5$ |
| 195. | $CH_2{=}\overset{\overset{CH_3}{\|}}{C}{-}\underset{\underset{O}{\|}}{C}{-}OC_3H_6{-}\overset{\overset{OC_3H_7}{\|}}{\underset{\underset{OC_3H_7}{\|}}{Si}}{-}OC_3H_7$ |
| 196. | $CH_2{=}\overset{\overset{CH_3}{\|}}{C}{-}\underset{\underset{O}{\|}}{C}{-}OC_3H_6{-}\overset{\overset{OC_4H_9}{\|}}{\underset{\underset{OC_4H_9}{\|}}{Si}}{-}OC_4H_9$ |
| 197. | $CH_2{=}\overset{\overset{CH_3}{\|}}{C}{-}\underset{\underset{O}{\|}}{C}{-}OC_4H_8{-}\overset{\overset{CH_3}{\|}}{\underset{\underset{CH_3}{\|}}{Si}}{-}OCH_3$ |
| 198. | $CH_2{=}\overset{\overset{CH_3}{\|}}{C}{-}\underset{\underset{O}{\|}}{C}{-}OC_5H_{10}{-}\overset{\overset{CH_3}{\|}}{\underset{\underset{OCH_3}{\|}}{Si}}{-}OCH_3$ |
| 199. | $CH_2{=}\overset{\overset{CH_3}{\|}}{C}{-}\underset{\underset{O}{\|}}{C}{-}OC_3H_6{-}\overset{\overset{C_2H_5}{\|}}{\underset{\underset{OCH_3}{\|}}{Si}}{-}OCH_3$ |
| 200. | $CH_2{=}\overset{\overset{CH_3}{\|}}{C}{-}\underset{\underset{O}{\|}}{C}{-}OC_3H_6{-}\overset{\overset{C_3H_7}{\|}}{\underset{\underset{OC_2H_5}{\|}}{Si}}{-}C_3H_7$ |
| 201. | $CH_2{=}\overset{\overset{CH_3}{\|}}{C}{-}\underset{\underset{O}{\|}}{C}{-}OC_3H_6{-}\overset{\overset{C_4H_9}{\|}}{\underset{\underset{OC_4H_9}{\|}}{Si}}{-}OC_4H_9$ |
| 202. | $CH_2{=}\overset{\overset{CH_3}{\|}}{C}{-}\underset{\underset{O}{\|}}{C}{-}OC_3H_6{-}\overset{\overset{CH_3}{\|}}{\underset{\underset{CH_3}{\|}}{Si}}{-}Cl$ |

-continued

No.

203.

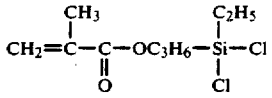

204.

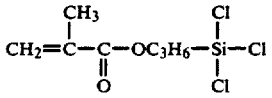

205.

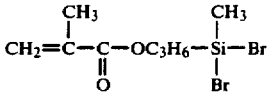

206.

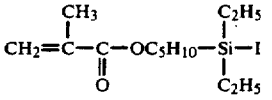

207.

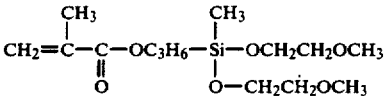

208.

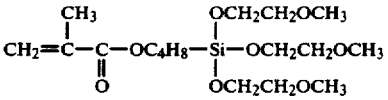

209.

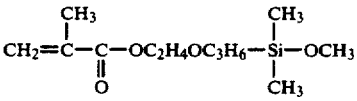

210.

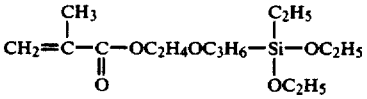

211.

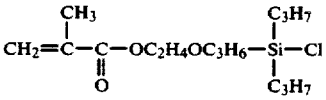

212.

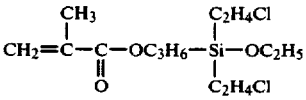

213.

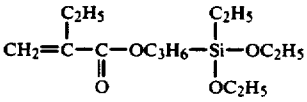

214.

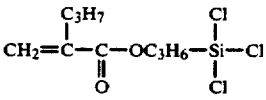

215.

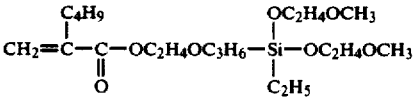

216.

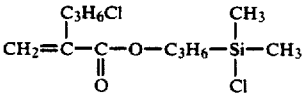

-continued

No.

217.

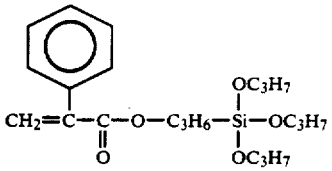

218.

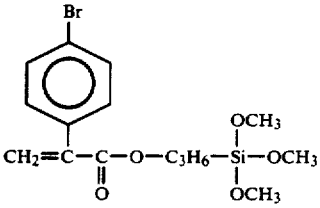

219.

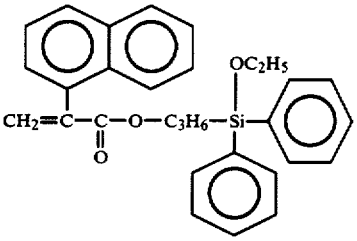

220.

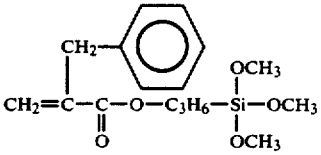

221.

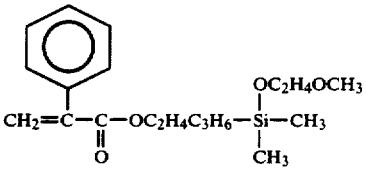

The silicone represented by formula (I) and/or formula (II) may be reacted with the silicone selected from formulas (III)–(V) to form a modified silicone.

The condensation reaction of the silicone of formula (I) and/or (II) with the silicone selected from formulas (III)–(V) can smoothly proceed following ordinary organic chemical reaction operations. For example, as shown in Japanese Patent Application Laid-open Nos. 58-167606 and 59-126478, the reaction mole ratios and reaction conditions are controlled and a stable modified silicone can be obtained.

As a compound having a polymerizable functional group, there may be mentioned polymerizable monomers having no silicon atom, or macromonomer composed of a polymer of a relatively low molecular weight, that is, a number average molecular weight of about 1000–10000 having polymerizable functional group at the end portion.

As a polymerizable monomer, there may be mentioned the following olefinic compounds, for example, straight chain unsaturated hydrocarbon of low molecular weight such as ethylene, propylene, butylene and the like, vinyl halide such as vinyl chloride, vinyl fluoride and the like, vinyl ester of organic acid such as vinyl acetate and the like, vinyl aromatic compound such as styrene, substituted styrene, vinyl pyridine, vinyl naphthalene and the like, acrylic acid, methacrylic acid, derivatives of acrylic acid and methacrylic acid such as the esters, amides, acrylonitrile and the like, N-vinyl compound such as N-vinylcarbazole, N-vinylpyrrolidone, N-vinylcaprolactam and the like, and vinyl silicon compound such as vinyltriethoxysilane and the like.

Disubstituted ethylene may be used. The examples are vinylidene fluoride, vinylidene chloride, and the like. In addition, there may be used maleic anhydride, maleic acid, fumaric acid and esters thereof.

As the polymerizable monomer, there may be used one polymerizable monomer, or two or more polymerzable monomers in combination.

As a method for producing the silicone type comb shaped graft polymer, there may be mentioned radical polymerization or ionic polymerization by solution polymerization method, suspension polymerization method, bulk polymerization method and the like. In particular, radical polymerization by solution polymerization method is preferable since it is simple and easy.

The copolymerization ratio is preferably 5–90% by weight, more preferably 10–70% by weight of content of a modified silicone. The molecular weight of the resulting polymer is preferably 500–100,000, more preferably 1000–50,000 as a number average molecular weight.

As the form of the surface layer containing a silicone type comb shaped graft polymer, there may be mentioned, for example, the following forms:

(1) In case that the surface layer itself is a photoconductive layer, the surface layer may be produced by dispersing or dissolving a photoconductive polymer or photoconductive powders in a binder resin, applying the resulting mixture and drying the mixture thus applied; and (2) In case that the surface layer is formed on a photoconductive layer, (a) the surface layer is a relatively thin film (about 0.1–10μ) and the image forming process is the same as that in (1) above, or (b) the surface layer is a relatively thick surface (about 10–50μ) and the image forming process is different from that in (1) above.

Since the silicone type comb shaped graft polymer has a structure as mentioned above, it is highly compatible with a liquid coating material containing a resin for forming the surface layer in the surface layer forms (1) and (2) above. Consequently, the resulting coating film is highly transparent and moreover, the silicone type comb shaped graft polymer does not move to the outside of the surface layer, for example, no exudation occurs, so that the effect of the said graft polymer can continue.

Furthermore, the said graft polymer can migrate towards the surface, and the side chains containing the silicone portion orient to the surface, that is, the said graft polymer has a good property of migration to the surface, and therefore, only a small amount of the said graft polymer added is sufficient to improve the surface property and impart a lubricating property and the surface exhibits a good cleaning property.

Therefore, remaining toner particles, paper powders, decomposition products produced by ozone generated by corona charging, on the surface layer of the image holding member after transferring of toner images can be effectively removed and the surface layer of the image holding member can be effectively protected from dirt. Stability of electric potential and stability of image quality upon successive copying can be achieved.

In the case of form (1) of the surface layer, since the branch containing the silicone portion of the silicone type comb shaped graft polymer has a property of migration to the surface as mentioned above, the graft polymer is not substantially present in the bulk of the photoconductive layer and the transport of light carrier is not disturbed and no trap is formed so that residual charge is not accumulated upon repeating an electrophotographic process, and stable charging characteristics are obtained.

Examples of form (1) of the surface layer are as shown below:

(1)-1 Containing a photoconductive polymer.

(1)-2 Photoconductive particles are dispersed or dissolved in a binder.

(1)-3 Constituted of a charge generation layer containing a charge generating material and a charge transport layer containing a charge transporting material.

A photoconductive layer in form (2) of the surface layer is (1)-1–(1)-3 as above.

Photoconductive polymers in form (1) are, for example, as shown below:

U.S. Pat. No. 3,244,517—high molecular weight polymers or resins prepared by condensation of saturated aliphatic aldehyde and primary aromatic amine such as aniline;

U.S. Pat. No. 3,163,531—high molecular weight polymers or resins prepared by condensation of an aromatic amine containing aromatic heterocyclic group and an unsaturated aldehyde, acrolein or alkyl substituted acrolein;

U.S. Pat. No. 3,240,597—Low molecular weight condensation polymer produced by condensation of formaldehyde or paraformaldehyde and anthracene or N-alkylcarbazole;

U.S. Pat. No. 3,770,428—Condensation polymer prepared by condensation of N-β-chloroethylcarbazole and formaldehyde or paraformaldehyde; and U.S. Pat. No. 3,037,861—Poly-N-vinylcarbazole polymer.

As photoconductive powders, there may be mentioned inorganic photoconductive particles such as amorphous silicon, selenium, selenium-tellurium alloy, selenium-arsenic alloy, cadmium sulfide, zinc oxide and the like, and organic photoconductive particles such as copper phthalocyanine, thioindigo, quinacridone, perylene pigment, anthraquinone pigment, azo pigment, bisazo pigment, cyanine pigment, perynone pigment and the like.

As dyes, there may be mentioned triphenylmethane dye such as methyl violet, brilliant green, crystal violet and the like, thiazine dye such as methylene blue and the like, quinone dye such as quinizarin and the like, cyanine dye, pyrylium salt, benzopyrylium salt and the like. These dyes may be used as a charge generating material.

As a charge transporting material, there may be mentioned: pyrene,

N-ethylcarbazole,

N-isopropylcarbazole,

N-methyl-N-phenylhydrazino-3-methylidene-9-ethylcarbazole,

N,N-diphenylhydrazino-3-methylidene-9-ethylcarbazole,

N,N-diphenylhydrazino-3-methylidene-10-ethylphenothiazine,
N,N-diphenylhydrazino-3-methylidene-10-ethylphenoxazine,
p-diethylaminobenzaldehyde-N,N-diphenylhydrazone,
p-diethylaminobenzaldehyde-N-α-naphthyl-N-phenylhydrazone,
p-pyrrolidinobenzaldehyde-N,N-diphenylhydrazone,
1,3,3-trimethylindolenine-ω-aldehyde-N,N-diphenylhydrazone,
p-diethylbenzaldehyde-3-methylbenzthiazolinone-2-hydrozone,
and the like hydrazones,
2,5-bis(p-diethylaminophenyl)-1,3,4-oxadiazole,
1-phenyl-3-(p-diethylaminostyryl)-5-(p-diethylaminophenyl)pyrazoline,
1-[quinolyl (2)]-3-(p-diethylaminostyryl)-5-(p-diethylaminophenyl)pyrazoline,
1-[pyridyl (2)]-3-(p-diethylaminostyryl)-5-(p-diethylaminophenyl)pyrazoline,
1-[6-methoxy-pyrizyl (2)]-3-(p-diethylaminostyryl)-5-(p-diethylaminophenyl)pyrazoline,
1-[pyridyl (3)]-3-(p-diethylaminostyryl)-5-(p-diethylaminophenyl)pyrazoline,
1-[lepidyl (2)]-3-(p-diethylaminostyryl)-5-(p-diethylaminophenyl)pyrazoline,
1-[pyridyl (2)]-3-(p-diethylaminostyryl)-4-methyl-5-(p-diethylaminophenyl)pyrazoline,
1-[pyridyl(2)]-3-(α-methyl-p-diethylaminostyryl)-5-(p-diethylaminophenyl)pyrazoline,
1-phenyl-3-(p-diethylaminostyryl)-4-methyl-5-(p-diethylaminophenyl)pyrazoline,
1-phenyl-3-(α-benzyl-p-diethylaminostyryl)-5-(p-diethylaminophenyl)pyrazoline, spiropyrazoline,
and the like pyrazolines,
2-(p-diethylaminostyryl)-6-diethylaminobenzoxazole,
2-(p-diethylaminophenyl)-4-(p-dimethylaminophenyl)-5-(2-chlorophenyl)oxazole,
and the like oxazole compounds,
2-(p-diethylaminostyryl)-6-diethylaminobenzothiazole,
and the like thiazole compounds, bis(4-diethylamino-2-methylphenyl)-phenylmethane,
and the like triarylmethane compounds, 1,1-bis(4-N,N-diethylamino-2-methylphenyl)heptane,
1,1,2,2-tetrakis(4-N,N-dimethylamino-2-methylphenyl)etane, and the like polyarylalkanes.

As a binder, there may be used polycarbonate resins, polyacrylate resins, polymers or copolymers of vinyl compounds such as styrene, vinyl acetate, vinyl chloride, acrylic acid esters, methacrylic acid esters, butadiene and the like, polyvinyl acetal, polysulfone, polyphenylene oxide, polyurethane, cellulose esters, cellulose ethers, phenoxy resins, silicone resins, epoxy resins and the like various polymers.

Preferable polycarbonate resins contain a linear polymer comprising one or more kinds of recurring units of formula (VI) below:

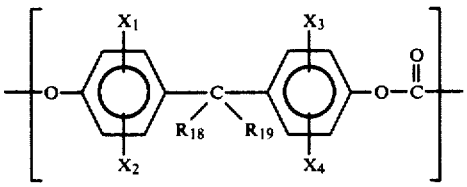

(VI)

where $R_{18}$ and $R_{19}$ are independently selected from hydrogen, alkyl such as methyl, ethyl, propyl, butyl and the like, and aryl such as phenyl, naphthyl and the like, and they may be substituted with halogen, lower alkyl, or the like. $R_{18}$ and $R_{19}$, taken together, may form a ring structure including the adjacent carbon atom, such as cyclohexyl, lactone and the like.

$X_1$, $X_2$, $X_3$ and $X_4$ are independently elected from hydrogen, halogen such as fluorine, chlorine, bromine and iodine, alkyl such as methyl, ethyl, propyl, butyl and the like, alicyclic alkyl such as cyclohexyl and the like, aryl such as phenyl, naphthyl and the like, and alkoxy such as methoxy, ethoxy and the like.

The above-mentioned polycarbonate resins can be produced, for example, by ordinary polycarbonate resin synthesis methods such as a phosgene method using one or more diol compounds of the following general formula:

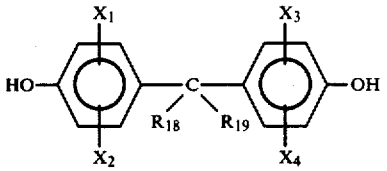

(VII)

where $R_{18}$, $R_{19}$, $X_1$, $X_2$, $X_3$ and $X_4$ are as defined above for formula (VI).

Preferable polyarylate resins contain linear polymers comprising one or more kinds of recurring units of the following formula (VIII):

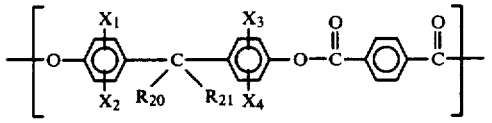

(VIII)

where, $R_{20}$ and $R_{21}$ are independently selected from hydrogen, alkyl such as methyl, ethyl, propyl, butyl and the like, and aryl such as phenyl, naphthyl and the like, and they may be substituted with halogen, lower alkyl and the like. $R_{20}$ and $R_{21}$, taken together, may form a ring structure together with the adjacent carbon atom, such as cyclohexyl, lactone structure and the like.

$X_1$, $X_2$, $X_3$ and $X_4$ are independently selected from hydrogen, halogen such as fluorine, chlorine, bromine, and iodine, alkyl such as methyl, ethyl, propyl, butyl and the like, alicyclic alkyl such as cyclohexyl and the like, aryl such as phenyl, naphthyl and the like, and alkoxy such as methoxy, ethoxy and the like.

The above-mentioned polyacrylate resins may be prepared by oridinary polyarylate resin synthesis methods, for example, a terephthalic acid chloride method using one or more kinds of the diol compounds of formula (VII) as above.

The amount of the silicone type comb shaped graft polymer to be added is preferably 0.01–10%, more preferably 0.05–5% based on the weight of solid matter in the surface layer.

When the amount of the said graft polymer is less than 0.01%, there is not obtained a sufficient surface improving effect. On the contrary, when the amount exceeds 10%, the said graft polymer present in the bulk of the coated film as well as in the surface region of the coated film so that whitening occurs due to the problem of compatibility with a resin and a photoconductive material which are main components of the surface layer, and further, residual charges are accumulated when an electrophotographic process is carried out repeatedly.

Upon producing an image holding member according to the present invention, as the substrate, there may be used, for example, a drum or film of a metal such as aluminum, stainless steel, and the like, paper and plastics.

The surface of the substrate may be provided with an underlying layer (adhesive layer) having both barrier function and underlying function.

A composition used for formation of the surface layer may be dispersed or dissolved in a solvent and the above-mentioned silicone type comb shaped graft polymer may be added thereto. The resulting coating liquid may be applied to the above-mentioned substrate or photoconductive layer by a coating method such as dip coating, spray coating, spinner coating, beads coating, blade coating, curtain coating, and the like, and then dried to produce an image holding member.

The following examples are given for explaining further the present invention. In the following, parts are by weight unless otherwise stated.

PREPARATION EXAMPLE (Sample No. k-1 silicone type comb shaped graft polymer in Table 1)

Silicone (0.01 mole) of the embodiment No. 26 (n: average degree of polymerization, 300) of the general formula (II) and 0.012 mole of pyridine were dissolved in 400 ml of diethyl ether. To this solution was gradually added dropwise a 10% solution of the compound of embodiment No. 58 of the general formula (III) (0.005 mole) in diethyl ether over 20 min. at room temperature. The reaction proceeded immediately to precipitate white crystal of pyridine hydrochloride. After completion of the dropwise addition, the solution was stirred at room temperature for further one hour, and the crystal of pyridine hydrochloride was removed by filtration. Then, the filtrate and 500 ml of water were placed in a separating funnel and stirred sufficiently for washing with water. After the water washing, the separating funnel was allowed to stand to separate the upper ether phase and the lower water phase.

Anhydrous sodium sulfate was added to the ether phase thus obtained and stood overnight for dehydration. Then, the anhydrous sodium sulfate was removed by filtration. The filtrate was subjected to a vacuum distillation to remove ether to obtain 165 g of a transparent colorless modified silicone.

20 parts of the modified silicone, 30 parts of styrene, 50 parts of methacrylate, 0.25 part of azobisisobutyronitrile (AIBN), and 60 parts of toluene were placed in a flask equipped with a condenser and a stirrer and reacted in an atmosphere of nitrogen at 80° C. for 24 hours. After completion of the reaction, the contents in the flask were poured into a large amount of methanol to precipitate a polymer and the polymer was collected by filtration. When the polymer was dried under reduced pressure, there was obtained 70 parts of a uniform white oil-like silicone type comb shaped graft polymer.

Other samples in Table 1 were also prepared.

TABLE 1

| | Composition of silicone type comb shaped graft polymer | | | |
|---|---|---|---|---|
| | Modified silicone | | | |
| Sample No. | Formulas (I), (II) | Formula (III) | Monomer for copolymerization | Modified silicone monomer |
| a-1 | 1 n: 30 | 48 | Methyl methacrylate 70 parts | parts 30 |
| b-1 | 2 n: 30 | 47 | Methyl methacrylate 80 | 20 |
| c-1 | 7 n: 30 | 63 | Styrene 85 | 15 |
| d-1 | 11 n: 300 | 71 | Styrene/Methyl methacrylate 60/30 | 10 |
| e-1 | 13 n: 300 | 89 | Styrene 70 | 30 |
| f-1 | 14 n: 30 | 111 | Methyl methacrylate 70 | 30 |
| g-1 | 22 n: 300 | 117 | Styrene 80 | 20 |
| h-1 | 26 n: 30 | 62 | Styrene 70 | 30 |
| i-1 | 27 n: 30 | 44 | Methyl methacrylate 85 | 15 |
| j-1 | 29 n: 300 | 53 | Methyl methacrylate 80 | 20 |
| k-1 | 26 n: 300 | 58 | Styrene/Methyl methacrylate 30/50 | 20 |
| l-1 | 35 n: 30 | 84 | Styrene 75 | 25 |
| m-1 | 36 n: 30 | 111 | Styrene 70 | 30 |

EXAMPLE 1

100 parts (All of the parts recited herein mean parts by weight) of zinc oxide powder for electrophotography (trade name: SAZEX 4000, produced by Sakai Kagaku), 0.5 parts of Rose Bengal as a coloring matter, 5 parts of methanol and 100 parts of toluene were dispersed thoroughly in a ball mill, and then the solvent was removed by means of absorption filtration. To the zinc oxide thus dyed and sensitized were added 20 parts of a butyral resin (trade name: BM-1, produced by Sekisui Kagaku K.K.), 20 parts of block isocyanate as a binder, 0.4 part of triethanolamine as a curing agent, and 50 parts of methyl ehtyl ketone and 20 parts of ethanol as a solvent. The mixture was again dispersed thoroughly in the ball mill to obtain a photoconductive coating material. The material was dip-coated on an aluminum cylinder (80$\phi \times$300 mm) subjected to underlying treatment, and hardened thermally at 120° C. for 30 minutes to form a photosensitive layer with a thickness of 25$\mu$. Next 20 parts of conductive $TiO_2$ (trade name: ECT-62, produced by Chitan Kogyo) was dispersed thoroughly in the ball mill in a solution of 100 parts of a AS resin (trade name: Sanlex C, produced by Mitsubishi Monsanto) in 1000 parts of MEK and 500 parts of cyclohexanone to obtain a coating liquid for a protective layer. Further, to the coating liquid was added 2 parts (as solid) of the silicone type comb shaped graft polymer (Sample No. a-1).

The thus prepared coating material was dip-coated on the above photosensitive layer and dried at 100° C. for 5 minutes to form a protective layer with a thickness of 2$\mu$. The resulting photosensitive member is referred to as Sample 1. The photosensitive member as Sample 2 was fabricated according to the same manner as in the above except that the silicone type comb shaped graft polymer of Sample No. b-1 was used in place of that of Sample No. a-1. Further, the photosensitive member as Sample 3 not containing any surface-modifying agent was fabricated according to the manner similar to the above, and was compared with Samples 1 and 2. A successive copying test of these photosensitive members was performed by repeating the electrophotographic process which comprises a −5.5 KV corona charging, an image exposure, a dry toner developing, transfer of the toner image to plain paper and cleaning by a urethane rubber blade. The results were shown in Table 1. The test was performed under the environmental condition of 32.5° C. and RH 90%.

TABLE 1

| | |
|---|---|
| Samples 1 and 2 | The stable high quality image was formed up to 3000 successive copying. |
| Sample 3 | Spot attachment of the melted toner was prominent on the surface layer at 500 successive copying. |

EXAMPLE 2

100 parts of CdS powder, 15 parts of a diallylphthalate resin (trade name: Daiso Dap produced by Osaka Soda Co., Ltd.) as a binder and 0.5 part of benzoyl peroxide were dissolved in the equivalently mixed solvent of methyl ethyl ketone (MEK) and xylene, and mixed thoroughly by roll mill apparatus to obtain a photoconductive coating material.

The material was coated by on an Al cylinder (80ϕ×300 mm) by a dipping method and cured at 120° C. for 10 minutes to form a photoconductive layer with a thickness of 40μ. Next, the diallylphthalate resin (as above) liquid containing 3 wt. % of benzoyl peroxide was coated thereon and cured at 120° C. for 10 minutes to form a resin layer with a thickness of 10μ. Next, a urethane acrylate resin (trade name: SONNE, produced by Kansai Paint Co., Ltd.) was coated and cured by UV irradiation to form a layer with a thickness of 10μ.

Further, 10 parts of a polysulfone resin (trade name: Udel P 1700, produced by UCC Corp.) was dissolved in 40 parts of monochlorobenzene and 30 parts of MEK, and 1.5 part (as solid) of the silicone type comb shaped graft polymer (Sample No. a-1) was added thereto. The resulting liquid was coated on the above-mentioned layer and dried at 100° C. for 20 minutes to form a surface layer with a thickness of 5μ. The resulting photosensitive member is referred to as Sample 4. Further, the photosensitive member as Sample 5 which did not contain the silicone type comb shaped graft polymer was fabricated according to the manner similar to the above, and was compared with Sample 4.

A successive copying test of these Samples was performed by repeating the electrophotographic process which comprises a primary 6 KV corona charging, a secondary AC corona charging and simultaneous image exposure, a whole surface light irradiation, a dry toner diveloping, transfer of a toner image to plain paper and cleaning by a urethane rubber blade. The results are shown in table 2. The test was performed under the environmental condition of 32.5° C. and RH 90%.

TABLE 2

| | |
|---|---|
| Sample 4 | A stable high quality image was formed up to 50000 successive copying. |
| Sample 5 | Black spot occurred by attachment of the melted toner at 2000 successive copying. |

EXAMPLE 3

10 parts of lactic casein produced in New Zealand was weighed, dispersed in 90 parts of water, and dissolved by adding 1 part of aqueous ammonia. On the other hand, 3 parts of hydroxypropyl methyl cellulose resin (trade name: Metorose 60 SH 50, produced by (Shinetsu Chemical Co., Ltd.) was dissolved in 20 parts of water. Then, the both solution were mixed to obtain a coating liquid for an underlying layer.

This mixture was coated by a dipping method on an Al cylinder (80ϕ×300 mm) and dried at 80° C. for 10 minutes to form an underlying layer with thickness of 2μ.

Next, 10 parts of a disazo pigment having the formula:

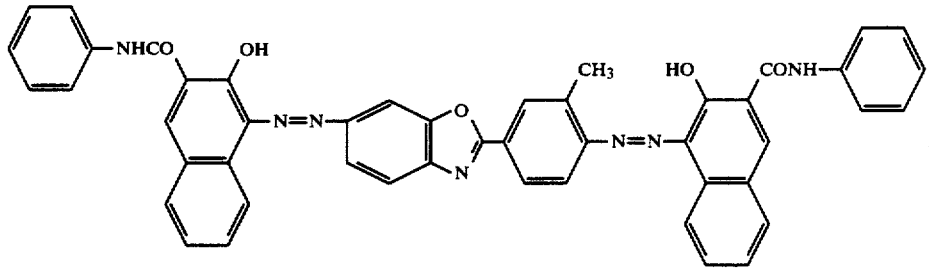

6 parts of cellulose acetate butyrate (trade name: CAB-381, produced by Eastman Chemical Products Inc.) and 60 parts of cyclohexanone were dispersed in a sand mill apparatus containing 1ϕ glass beads for 20 hours. 100 parts of methyl ethyl ketone was added thereto. The resulting liquid was dip-coated on the above underlying layer and dried thermally at 100° C. for 10 minutes to form a charge generation layer of the coated quantity of 0.1 g/cm$^2$.

Next, 10 parts of a hydrazone compound having the formula:

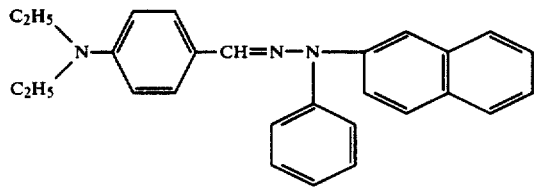

and 10 parts of methyl methacrylate-styrene copolymer resin (trade name: MS-600, produced by Nippon Steel Chemical Co., Ltd.) were dissolved in 55 parts of monochlorobenzene. 1.0 part (as solid) of the silicone type graft polymer (Sample a-1) was added to this solution. The resulting liquid was coated on the above charge generation layer and dried by a blast of hot air at 100° C. for 1 hour to form a charge transport layer with a thickness of 16μ. The resulting photosensitive member was referred to as Sample 6.

Using the silicone type comb shaped graft polymers of Sample Nos. b-1-m-1, the respective photosensitive member were fabricated according to the same manner as in the above (Samples 7-18).

Further, the photosensitive member as Sample 19 which did not contain the silicone type comb shaped graft polymer was fabricated according to the manner similar to the above, and was compared with Samples 6-18.

A successive copying test of these photosensitive members was performed by repeating the electrophotographic process which comprises a −5.6 KV corona charging, an image exposure, a dry toner developing, transfer of a toner to plain paper and cleaning by an urethane rubber blade. The test was performed under the environmental condition of 32.5° C. and RH 90%. The results are shown in Table 3.

TABLE 3

| | |
|---|---|
| Sample 6-18 | A stable high quality image was formed up to 5000 successive copying. |
| Sample 19 | At 700 successive copying, image running of belt shape and blank area occurred. |

EXAMPLE 4

10 parts of lactic casein produced in New Zealand was weighed, dispersed in 90 parts of water, and dissolved by adding 1 part of aqueous ammonia. On the other hand, 3 parts of hydroxypropyl ethyl cellulose resin (trade name: Metorose 60 SH 50, produced by Shinetsu Chemical Co., Ltd.) was dissolved in 20 parts of water. Then, the both solutions were mixed to obtain a coating liquid for an underlying layer.

This mixture was coated by the dipping method on the Al cylinder (80ϕ×300 mm) and dried at 80° C. for 10 minutes to form an underlying layer with a thickness of 10μ.

Next, 12 parts of a pyrazoline compound having the formula:

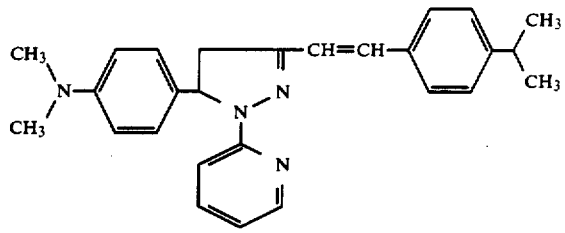

and 10 parts of a polysulfone resin (trade name: Udel P-1700, produced by UCC Corp.) were dissolved in 52 parts of monochlorobenzene. This solution was dip-coated on the above underlying layer and dried at 100° C. for 1 hour to form a charge transport layer with a thickness of 16μ.

10 parts of a bisazo pigment having the formula:

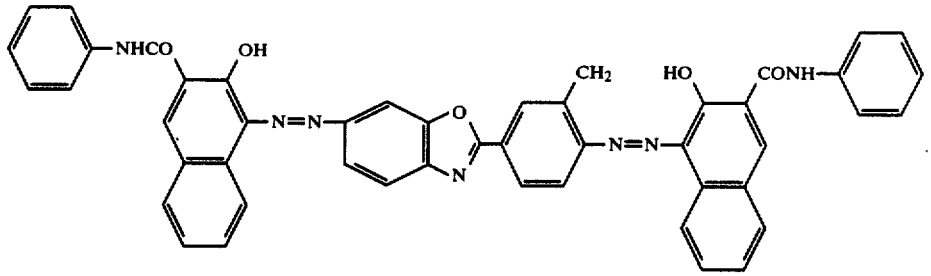

5 parts of poly(vinyl butyral) (trade name: S-LEC BM-S, produced by Sekisui Kagaku K.K.) and 30 parts of butyl acetate were dispersed in a sand mill apparatus containing 1ϕ glass beads for 20 hours. This dispersion liquid, to which 40 parts of ethanol and 0.3 part (as solid) of the Sample a-1 silicone type polymer were added, was dip-coated on the above charge transport layer and dried at 100° C. for 5 minutes to form a charge generation layer with a thickness of 0.15μ. The resulting photosensitive member was referred to as Sample 20.

Using the silicone type comb shaped graft polymers of Sample Nos. b-1-m-1, the respective photosensitive member were fabricated according to the same manner as in the above (Samples 21-32). Further, a photosensitive member as Sample 33 containing no silicone type comb shaped graft polymer was fabricated according to the manner similar to the above, and was compared with Sample 20-32.

A successive copying test of these photosensitive members was performed by repeating the electrophotographic process which comprises a +5.6 KV corona charging, an image exposure, a dry toner developing, transfer of a toner to plain paper and cleaning by a urethane rubber blade and so on. The test was performed under the environmental condition of 32.5° C. and RH 90%. The results are shown in Table 4.

TABLE 4

| | |
|---|---|
| Sample 20-32 | A stable high quality image was formed up to 3000 successive copying. |
| Sample 33 | At 500 successive copying, attachment of the melted toner was prominent on the surface layer and many black spots were formed on the image. |

COMPARATIVE EXAMPLE

A photosensitive member as Sample 34 was fabricated by the same manner as in Example 1 except that 1.0 part (as solid) of silicone oil (trade name: KF 96, produced by Shinetsu Silicone) was used in place of the silicone type comb shaped polymer.

Except for using the above silicone oil in place of the silicone type comb shaped graft polymers used in Examples 2, 3 and 4, the photosensitive members as Samples 35, 36 and 37 were fabricated by the same manner as in the above examples, respectively. Successive copying tests of these Samples were performed under the condition in the respective Examples. As a result, base fogging occurred awfully and as the copy was repeated, the degree of fogging increased. In one month after the fabrication of Samples 34, 35, 36 and 37, it was observed that the silicone oil shifted to the surface layer, thereby forming a stain. On the other hand, as to Samples 1, 2, 4, 6–18 and 20–32 containing the silicone type comb shaped graft polymer, the above change with the lapse of time was not recognized and these photosensitive members had the exterior and characteristics similar to those at the beginning of the successive copying.

EXAMPLE 5

Frictional force between the urethane blade and the surface layer was measured for Samples 1–37. The results are shown in Table 5.

TABLE 5

| Sample | Frictional force | Sample | Frictional force | Sample | Frictional force |
|---|---|---|---|---|---|
| 1 | 0.33 | 14 | 0.26 | 27 | 0.28 |
| 2 | 0.32 | 15 | 0.27 | 28 | 0.27 |
| 3 | 0.98 | 16 | 0.27 | 29 | 0.27 |
| 4 | 0.30 | 17 | 0.28 | 30 | 0.26 |
| 5 | 0.99 | 18 | 0.30 | 31 | 0.28 |
| 6 | 0.26 | 19 | 1.00 | 32 | 0.30 |
| 7 | 0.25 | 20 | 0.28 | 33 | 0.99 |
| 8 | 0.28 | 21 | 0.28 | 34 | 0.29 |
| 9 | 0.27 | 22 | 0.27 | 35 | 0.29 |
| 10 | 0.26 | 23 | 0.26 | 36 | 0.29 |
| 11 | 0.24 | 24 | 0.24 | 37 | 0.25 |
| 12 | 0.25 | 25 | 0.28 | | |
| 13 | 0.27 | 26 | 0.27 | | |

*Frictional force is a relative value in the case where the frictional force of Sample 19 is regarded as standard value.

EXAMPLE 6

There were measured the dark portion potential ($V_D$) and the light portion potential ($V_L$) at the initial stage and after repeated use of 3000 times performed by the same electrophotographic process as and under the same environmental condition in this process as in Examples 1, 2, 3 and 4, for observing the potential change between the potential at the initial stage and that after repeated use of 3000 times. A part of the results is shown in Table 6.

TABLE 6

| Sample No. | Surface-modifying material | Initial stage $V_D$(v) | Initial stage $V_L$(v) | After 3000 successive copying $V_D$(v) | After 3000 successive copying $V_L$(v) |
|---|---|---|---|---|---|
| 1 | A | −820 | −170 | −720 | −200 |
| 34 | B | −820 | −180 | −700 | −280 |
| 3 | non addition | −820 | −180 | −690 | −340 |
| 4 | A | +940 | +190 | +890 | +220 |
| 35 | B | +950 | +190 | +890 | +250 |

TABLE 6-continued

| Sample No. | Surface-modifying material | Initial stage $V_D$(v) | Initial stage $V_L$(v) | After 3000 successive copying $V_D$(v) | After 3000 successive copying $V_L$(v) |
|---|---|---|---|---|---|
| 5 | non addition | +960 | +200 | +860 | +270 |
| 6 | A | −840 | −150 | −790 | −190 |
| 36 | B | −840 | −160 | −780 | −240 |
| 19 | non addition | −840 | −150 | −770 | −270 |
| 20 | A | +800 | +210 | +760 | +240 |
| 37 | B | +790 | +220 | +740 | +270 |
| 33 | non addition | +800 | +210 | +730 | +300 |

Surface-modifying material:
A—silicone type comb shaped graft polymer
B—silicone oil

PREPARATION EXAMPLE (Sample No. h-2 silicone type comb shaped graft polymer in Table 7)

Silicone (0.01 mole) of the embodiment No. 26 (n: average degree of polymerization 300) of the general formula (II) and 0.012 mole of pyridine were dissolved in 400 ml of diethylether.

To this solution was gradually added dropwise a 10% diethylether solution of the compound (0.005 mole) of the embodiment No. 133 of the general formula (IV) over 20 minutes at room temperature. The reaction proceeded immediately and a white crystal precipitate of pyridine hydrochloride are formed. After the termination of the dropping, the above solution was stirred at room temperature for one hour and the crystal of pyridine hydrochloride was removed by filtration. Next, this filtrate and 500 ml of water were poured into a reparating funnel and stirred thoroughly for rinsing. After the rinsing, the separating funnel was permitted to stand to separate the ether phase as the upper phase and the water phase as the lower phase. The obtained ether phase, to which anhydrous sodium sulfate was further added, was left overnight for dehydration. Then, anhydrous sodium sulfate was removed by filtration. The filtrate was subjected to a vacuum distillation to remove ether and 150 g of a transparent and colorless modified silicone was obtained.

Next, 30 parts of the obtained modified silicone, 70 parts of styrene, 0.25 part of AIBN and 60 parts of toluene were poured into a flask provided with a condenser and stirrer, and reacted under nitrogen atmosphere at 80° C. for 24 hours. After completion of the reaction, the contents of the flask was added to a large quantity of methanol to deposit the polymer. The polymer was removed by filtration, dried in vacuo to give 78 parts of the uniform silicone type graft copolymer in a form of white oil.

Other graft polymers recited in Table 7 were also prepared.

TABLE 7

| Sample No. | Composition of silicone type comb shaped graft polymer: Modified silicone: Formulas (I), (II) | Formula (IV) | Polymerizable monomer | Modified silicone |
|---|---|---|---|---|
| a-2 | 1 n: 30 | 112 | methyl methacrylate (parts) 70 | 30 parts |
| b-2 | 2 n: 30 | 113 | styrene 80 | 20 |
| c-2 | 7 n: 30 | 114 | Methyl methacrylate | 10 |

TABLE 7-continued

| Sample No. | Composition of silicone type comb shaped graft polymer: Modified silicone: Formulas (I), (II) | Formula (IV) | Polymerizable monomer | Modified silicone |
|---|---|---|---|---|
| | | | 90 | |
| d-2 | 11 n: 300 | 115 | styrene/ methyl methacrylate 42.5/42.5 | 15 |
| e-2 | 13 n: 300 | 122 | styrene 70 | 30 |
| f-2 | 14 n: 30 | 123 | styrene 70 | 30 |
| g-2 | 22 n: 300 | 124 | methyl methacrylate 80 | 20 |
| h-2 | 26 n: 30 | 133 | styrene 70 | 30 |
| i-2 | 27 n: 30 | 112 | styrene 85 | 15 |
| j-2 | 29 n: 300 | 114 | methyl methacrylate 80 | 20 |
| k-2 | 26 n: 300 | 122 | styrene/ methyl methacrylate 45/45 | 10 |
| l-2 | 35 n: 30 | 124 | styrene 70 | 30 |
| m-2 | 36 n: 30 | 137 | methyl methacrylate 75 | 25 |

EXAMPLE 7

100 parts of zinc oxide powder for an electrophotography (trade name: SAZEX 4000, produced by Sakai Kagaku), 0.5 part of Rose Bengal as a coloring matter, 5 parts of methanol and 100 parts of toluene were dispersed thoroughly in a ball mill, and then the solvent was removed by means of absorption filtration. To the zinc oxide thus dyed and sensitized were added 20 parts of a butyral resin (trade name: BM-1, produced by Sekisui Kagaku K.K.) and 20 parts of block isocyanate as a binder, 0.4 part of triethanolamino as a curing agent, and 50 parts of methyl ethyl ketone and 20 parts of ethanol as a solvent. The mixture was again dispersed thoroughly in the ball mill to obtain photoconductive coating material. The material was dip-coated on an aluminum cylinder (80$\phi\times$300 mm) subjected to underlying treatment, and cured thermally at 120° C. for 30 minutes to form a photosensitive layer with a thickness of 25$\mu$. Next, 20 parts of conductive $TiO_2$ (trade name: ECT-62, produced by Chitan Kogyo) was dispersed thoroughly in the ball mill in a solution of 100 parts of a AS resin (trade name: Sanlex C, produced by Mitsubishi Monsanto) in 1000 parts of MEK and 500 parts of cyclohexanone to obtain a coating liquid for a protective layer. Further, to the coating liquid was added 2 parts (as solid) of the silicone type comb shaped graft polymer (Sample No. a-2).

The thus prepared coating material was dip-coated on the above photosensitive layer and dried at 100° C. for 5 minutes to form a protective layer with a thickness of 2$\mu$. The resulting photosensitive member is referred to as Sample 38. The photosensitive member as Sample 39 was fabricated according to the same manner as in the above except that the silicone type comb shaped graft polymer of Sample No. b-2 was used in place of that of Sample No. a-2. A successive copying test of these photosensitive members was performed by repeating the electrophotographic process which comprises a-5.5 KV corona charging, an image exposure, a dry toner developing, transfer of a toner to plain paper and cleaning by a urethane rubber blade. As a result, the stable high quality image was formed up to 3000 successive copying. The test was performed under the environmental condition of 32.5° C. and RH 90%.

EXAMPLE 8

100 parts of CdS powder, 15 parts of a diallylphthalate resin (trade name: Daiso Dap produced by Osaka Soda Co., Ltd.) as a binder and 0.5 part of benzoyl peroxide were dissolved in the equivalently mixed solvent of methyl ethyl ketone (MEK) and xylene, and mixed thoroughly by a roll mill apparatus to obtain a photoconductive coating material. The material was coated on an Al cylinder (80$\phi\times$300 mm) by the dipping method and cured at 120° C. for 10 minutes to form a photoconductive layer with a thickness of 40$\mu$. Next, the diallylphthalate resin (as above) liquid containing 3 wt.% of benzoyl peroxide was coated thereon and cured at 120° C. for 10 minutes to form a resin layer with a thickness of 10$\mu$.

Next, a urethane acrylate resin (trade name: SONNE, produced by Kansai Paint Co., Ltd.) was coated and cured by UV irradiation to form a layer with a thickness of 10$\mu$.

Further, 10 parts of a polysulfone resin (trade name: Udel P 1700, produced by UCC Corp.) was dissolved in 40 parts of monochlorobenzene and 30 parts of MEK, and 1.5 part (as solid) of the silicone type comb shaped graft polymer (Sample No. a-2) was added thereto. The resulting liquid was coated on the above layer and dried at 100° C. for 20 minutes to form a surface layer with a thickness of 5$\mu$. The resulting photosensitive member is referred to as Sample 40.

A successive copying test of these Samples was performed by repeating the electrophotographic process which comprises a primary +6 KV corona charging, a secondary AC corona charging simultaneously with image exposure, a whole surface light irradiation, a dry toner developing, transfer of a toner image to plain paper and cleaning by a urethane rubber blade.

The test was performed under the environmental condition of 32.5° C. and RH 90%. As a result, the stable high quality image was formed up to 50,000 succesive copying.

EXAMPLE 9

10 parts of lactic casein produced in New Zealand was weighed, dispersed in 90 parts of water, and dissolved by adding 1 part of aqueous ammonia. On the other hand, 3 parts of hydroxypropyl methyl cellulose resin (trade name: Metorose 60 SH 50, produced by Shinetsu Chemical Co., Ltd.) was dissolved in 20 parts of water. Then, the both solutions were mixed to obtain a coating liquid for an underlying layer.

This mixture was coated by a dipping method on an Al cylinder (80$\phi\times$300 mm) and dried at 80° C. for 10 minutes to form an underlying layer with a thickness of 2$\mu$.

Next, 10 parts of a disazo pigment having the formula:

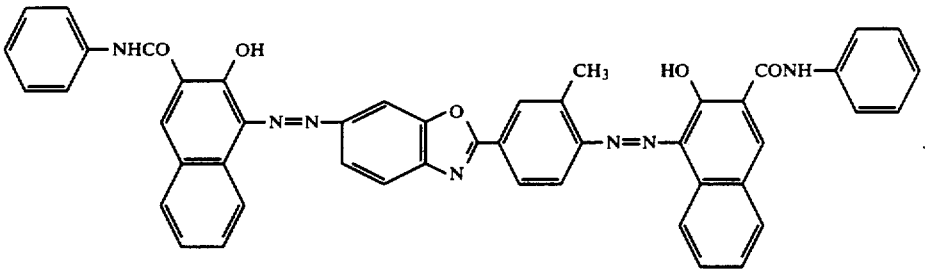

6 parts of cellulose acetate butyrate (trade name: CAB-381, produced by Eastman Chemical Products Inc.) and 60 parts of cyclohexanone were dispersed in a sand mill apparatus containing 1ϕ glass beads for 20 hours. 100 parts of methyl ethyl ketone was added thereto. The resulting liquid was dip-coated on the above underlying layer and dried thermally at 100° C. for 10 minutes to form a charge generation layer of a coated quantity of 0.1 g/cm$^2$.

Next, 10 parts of a hydrozone compound having the formula:

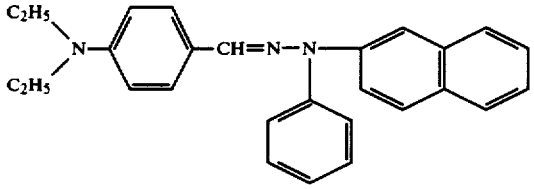

and 10 parts of methyl methacrylate-styrene copolymer resin (trade name: MS-600, produced by Nippon Steel Chemical Co., Ltd.) were dissolved in 55 parts of monochlorobenzene. 1.0 part (as solid) of the silicone type graft polymer (Sample a-2) was added to this solution. The resulting liquid was coated on the above charge generation layer and dried by a blast of hot air at 100° C. for 1 hour to form a charge transport layer with a thickness of 16μ. The resulting photosensitive member was referred to as Sample 41.

Using the silicone type comb shaped graft polymers of Sample Nos. b-2-m-2, the respective photosensitive members were fabricated according to the same manner as in the above (Samples 42-53.

A successive copy test of these photosensitive members was performed by repeating the electrophotographic process which comprises a −5.6 KV corona charging, an image exposure, a dry toner developing, transfer of a toner to plain paper and cleaning by a urethane rubber blade. The test was performed under the environmental condition of 32.5° C. and RH 90%. As a result, a stable high quality image was formed up to 5000 successive copying.

EXAMPLE 10

10 parts of lactic casein produced in New Zealand was weighed, dispersed in 90 parts of water, and dissolved by adding 1 part of aqueous ammonia. On the other hand, 3 parts of hydroxypropyl methyl cellulose resin (trade name: Metorose 60 SH 50, produced by Shinetsu Chemical Co., Ltd.) was dissolved in 20 parts of water. Then, the both solutions were mixed to obtain a coating liquid for an underlying layer.

This mixture was coated by a dipping method on an Al cylinder (80ϕ×300 mm) and dried at 80° C. for 10 minutes to form an underlying layer with a thickness of 10μ.

Next, 12 parts of a pyrazoline conpound having the formula:

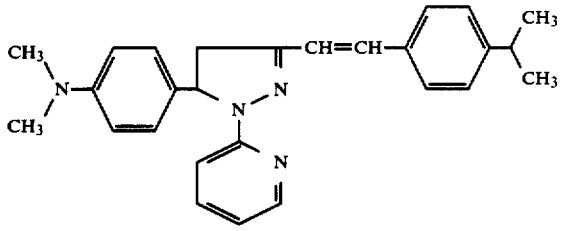

and 10 parts of a polysulfone resin (trade name: Udel P-1700, produced by UCC Corp.) were dissolved in 52 parts of monochlorobenzene. This solution was dip-coated on the above underlying layer and dried at 100° C. for 1 hour to form a charge transport layer with a thickness of 16μ.

10 parts of a bisazo pigment having the formula:

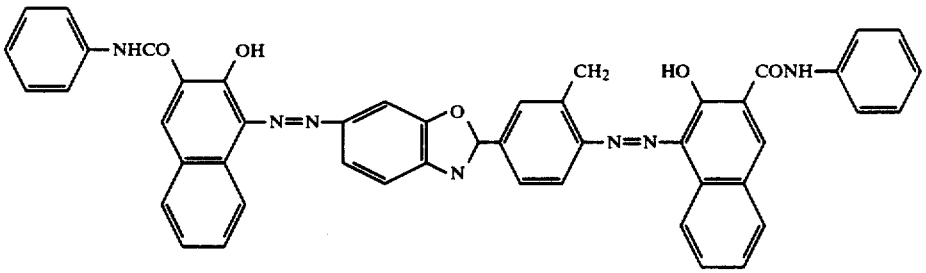

5 parts of poly(vinyl butyral) (trade name: S-LEC BM-S, produced by Sekisui Kagaku K.K.) and 30 parts of butyl acetate were dispersed in a sand mill apparatus containing 1ϕ glass beads for 20 hours. This dispersion liquid, to which 40 parts of ethanol and 0.3 part (as solid) of the Sample a-2 silicone type polymer were added, was dip-coated on the above charge transport layer and dried at 100° C. for 5 minutes to form a charge generation layer with a thickness of 0.15μ. The resulting photosensitive member was referred to as Sample 54.

Using the silicone type comb shaped graft polymers of Sample Nos. b-2-m-2, the respective photosensitive member were fabricated according to the same manner as in the above (Samples 55-66).

A successive copying test of these photosensitive members was performed by repeating the electrophotographic process which comprises a +5.6 KV corona charging, an image exposure, a dry toner developing, transfer of a toner image to plain paper and cleaning by a urethane rubber blade and so on. The test was performed under the environmental condition of 32.5° C. and RH 90%. As a result, a stable high quality image was formed up to 3000 successive copying.

EXAMPLE 11

Frictional force between the urethane blade and the surface layer was measured for Samples 38-65. The results is shown in Table 8.

TABLE 8

| Sample No. | Frictional force | Sample No. | Frictional force | Sample No. | Frictional force |
|---|---|---|---|---|---|
| 38 | 0.35 | 49 | 0.25 | 61 | 0.30 |
| 39 | 0.30 | 50 | 0.28 | 62 | 0.29 |
| | | 51 | 0.25 | 63 | 0.28 |
| 40 | 0.30 | 52 | 0.27 | 64 | 0.25 |
| | | 53 | 0.28 | 65 | 0.27 |
| 41 | 0.25 | | | 66 | 0.29 |
| 42 | 0.26 | 54 | 0.28 | | |
| 43 | 0.25 | 55 | 0.29 | | |
| 44 | 0.24 | 56 | 0.24 | | |
| 45 | 0.27 | 57 | 0.24 | | |
| 46 | 0.28 | 58 | 0.28 | | |
| 47 | 0.24 | 59 | 0.27 | | |
| 48 | 0.25 | 60 | 0.22 | | |

*Frictional force is a relative value in the case where the frictional force of Sample 19 is regarded as standard value 1.

EXAMPLE 12

There were measured the dark portion potential ($V_D$) and the light portion potential ($V_L$) at the initial stage and after repeated use of 3000 times performed by the same electrophotographic process as and under the same environmental condition as in Examples 7, 8, 9 and 10, for observing the potential charge between the potential at the initial stage and that after repeated use of 3000 times. A part of the results is shown in Table 9.

TABLE 9

| Sample | Initial stage | | After 3000 successive copying | |
|---|---|---|---|---|
| No. | $V_D$(v) | $V_L$(v) | $V_D$(v) | $V_L$(v) |
| 38 | −850 | −170 | −750 | −190 |
| 40 | +950 | +200 | +900 | +230 |
| 41 | −830 | −160 | −790 | −200 |
| 54 | +810 | +200 | +770 | +230 |

PREPARATION EXAMPLE (Sample No. k-3 silicone type comb shaped graft polymer in Table 10)

Silicone (0.01 mole) of the embodiment No. 26 (n: average degree of polymerization 300) of the general formula (II) and 0.012 mole of pyridine were dissolved in 400 ml of diethylether. To this solution was gradually added dropwise a 10% diethylether solution of the compound (0.005 mole) of the embodiment No. 181 of the general formula (V) over 20 minutes at room temperature. The reaction proceeded immediately and a white crystal precipitate of pyridine hydrochloride occurred. After the termination of the dropping, the above solution was stirred at room temperature for one hour and the crystal of pyridine hydrochloride was removed by filtration. Next, this filtrate and 500 ml of water were poured into a separating funnel and stirred thoroughly for rinsing. After the rinsing, the separating funnel was permitted to stand to separate the ether phase as the upper phase and the water phase as the lower phase. The obtained ether phase, in which anhydrous sodium sulfate was further added, was left overnight for dehydration. Then, anhydrous sodium sulfate was removed by filtration. The filtrate was subjected to a vacuum distillation to remove ether and 200 g of a modified silicone (transparent and colorless) was produced.

Next, 30 parts of the obtained modified silicone, 70 parts of methyl methacrylate, 0.25 part of AIBN and 60 parts of toluene were poured into a flask provided with a condenser and stirrer, and reacted under nitrogen atmosphere at 80° C. for 24 hours. After completion of the reaction, the contents of the flask was added to a large quantity of methanol to deposit the polymer.

The polymer was removed by filtration, dried in vacuo to give 82 parts of a uniform silicone type graft copolymer as a white oil.

Other graft polymers recited in Table 10 were also prepared.

TABLE 10

| | Composition of silicone type comb shaped graft polymer | | | |
|---|---|---|---|---|
| | Modified silicone | | | Modified |
| Sample No. | Formulas (I), (II) | Formula (V) | Monomer for copolymerization | silicone monomer |
| a-3 | 1 n: 30 | 164 | Methyl methacrylate 80 parts | 20 parts |
| b-3 | 2 n: 30 | 192 | Styrene/methyl methacrylate 90 | 10 |
| c-3 | 7 n: 30 | 210 | Styrene 70 | 30 |
| d-3 | 11 n: 300 | 182 | Methyl methacrylate 30 | 70 |
| e-3 | 13 n: 300 | 212 | Styrene 85 | 15 |
| f-3 | 14 n: 30 | 217 | Methyl methacrylate 75 | 25 |
| g-3 | 22 n: 300 | 175 | Methyl methacrylate 70 | 30 |
| h-3 | 26 n: 30 | 193 | Styrene 80 | 20 |
| i-3 | 27 n: 30 | 173 | Styrene 80 | 20 |
| j-3 | 29 n: 300 | 208 | Styrene/methyl methacrylate 35/35 | 30 |
| k-3 | 26 n: 300 | 181 | Methyl methacrylate 70 | 30 |
| l-3 | 35 n: 30 | 166 | Methyl methacrylate 85 | 15 |
| m-3 | 36 n: | 216 | Styrene | |

TABLE 10-continued

| Sample No. | Composition of silicone type comb shaped graft polymer: Modified silicone: Formulas (I), (II) | Formula (V) | Monomer for copolymerization | Modified silicone monomer |
|---|---|---|---|---|
| | 30 | | 75 | 25 |

EXAMPLE 13

100 parts (All of the parts recited herein mean parts by weight) of zinc oxide powder for an electrophotography (trade name: SAZEX 4000, produced by Sakai Kagaku), 0.5 parts of Rose Bengal as a coloring matter, 5 parts of methanol and 100 parts of toluene were dispersed thoroughly in a ball mill, and then the solvent was removed by means of absorption filtration. To the zinc oxide thus dyed and sensitized were added 20 parts of a butyral resin (trade name: BM-1, produced by Sekisui Kagaku K.K.) and 20 parts of block isocyanate as a binder, 0.4 part of triethanolamine as a curing agent, and 50 parts of methyl ethyl ketone and 20 parts of ethanol as a solvent. The mixture was again dispersed thoroughly in the ball mill to obtain a photoconductive coating material.

The material was dip-coated on an aluminum cylinder (80ϕ×300 mm) subjected to underlying treatment, and cured thermally at 12° C. for 30 minutes to form a photosensitive layer with a thickness of 25μ. Next, 20 parts of conductive $TiO_2$ (trade name: ECT-62, produced by Chitan Kogyo) was dispersed thoroughly in the ball mill in a solution of 100 parts of a AS resin (trade name: Sanlex C, produced by Mitsubishi Monsanto) in 1000 parts of MEK and 500 parts of cyclohexanone to obtain a coating liquid for a protective layer.

Further, to the coating liquid was added 2 parts (as solid) of the silicone type comb shaped graft polymer (Sample No. a-3).

The thus prepared coating material was dip-coated on the above photosensitive layer and dried at 100° C. for 5 minutes to form a protective layer with a thickness of 2μ. The resulting photosensitive member is referred to as Sample 67. The photosensitive member as Sample 68 was fabricated according to the same manner as in the above except that the silicone type comb shaped graft polymer of Sample No. b-3 was used in place of that of Sample No. a-3.

A successive copying test of these photosensitive members was performed by repeating the electrophotographic process which comprises a −5.5 KV corona charging, an image exposure, a dry toner developing, transfer of a toner to plain paper and cleaning by a urethane rubber blade. The test was performed under the environmental condition of 32.5° C. and RH 90%. As a result, a stable high quality image was formed up to 3000 successive copying.

EXAMPLE 14

100 parts of CdS powder, 15 parts of a diallylphthalate resin (trade name: Daiso Dap produced by Osaka Soda Co., Ltd.) as a binder and 0.5 part of benzoyl peroxide were dissolved in the equivalently mixed solvent of methyl ethyl ketone (MEK) and xylene, and mixed thoroughly by a roll mill apparatus to obtain a photoconductive coating material. The material was coated on an Al cylinder (80ϕ×300 mm) by a dipping method and cured at 120° C. for 10 minutes to form a photoconductive layer with a thickness of 40μ. Next, the diallylphthalate resin (as above) liquid containing 3 wt. % of benzoyl peroxide was coated thereon and cured at 120° C. for 10 minutes to form a resin layer with a thickness of 10 μm.

Next, a urethane acrylate resin (trade name: SONNE, produced by Kansai Paint Co., Ltd.) was coated and cured by UV irradiation to form a layer with a thickness of 10μ.

Further, 10 parts of a polysulfone resin (trade name: Udel P 1700, produced by UCC Corp.) was dissolved in 40 parts of monochlorobenzene and 30 parts of MEK, and 1.5 part (as solid) of the silicone type comb shaped graft polymer (Sample No. a-3) was added thereto. The resulting liquid was coated on the above layer and dried at 100° C. for 20 minutes to form a surface layer with a thickness of 5μ. The resulting photosensitive member is referred to at Sample 69.

A successive copying test of these Samples was performed by repeating the electrophotographic process which comprises a primary +6 KV corona charging, a second AC corona charging simultaneously with imagewise exposure, a whole surface light irradiation, a dry toner developing, transfer of a toner to plain paper and cleaning by a urethane rubber blade. The test was performed under the environmental condition of 32.5° C. and RH 90%. As a result, the stable high quality image was formed up to 50,000 successive copying.

EXAMPLE 15

10 parts of lactic casein produced in New Zealand was weighed, dispersed in 90 parts of water, and dissolved by adding 1 part of aqueous ammonia. On the other hand, 3 parts of hydroxypropyl methyl cellulose resin (trade name: Metorose 60 SH 50, produced by Shinetsu Chemical Co., Ltd.) was dissolved in 20 parts of water. Then, the both solutions were mixed to obtain a coating liquid for an underlying layer.

This mixture was coated by the dipping method on an Al cylinder (80ϕ×300 mm) and dried at 80° C. for 10 minutes to form an underlying layer with a thickness of 2μ.

Next, 10 parts of a disazo pigment having the formula:

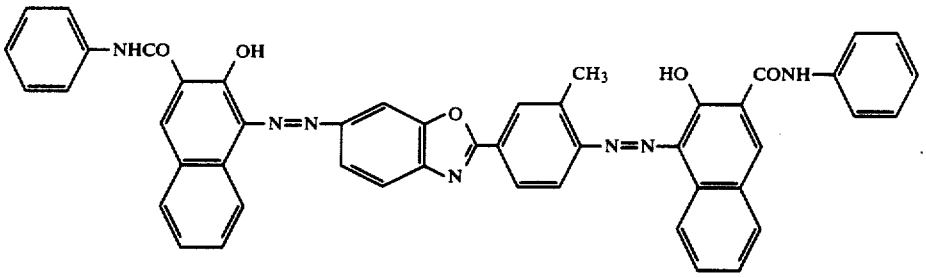

6 parts of cellulose acetate butyrate (trade name: CAB-381, produced by Eastman Chemical Products Inc.) and 60 parts of cyclohexanone were dispersed in a sand mill apparatus containing 1$\phi$ glass beads for 20 hours. 100 parts of methyl ethyl ketone was added thereto. The resulting liquid was dip-coated on the above underlying layer and dried thermally at 100° C. for 10 minutes to form a charge generation layer of a coated quantity of 0.1 g/cm$^2$.

Next, 10 parts of a hydrazone compound having the formula:

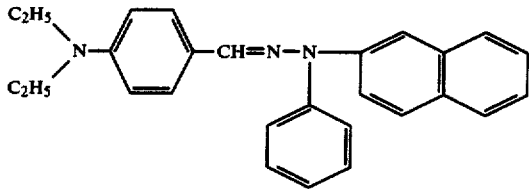

and 10 parts of methyl methacrylate-styrene copolymer resin (trade name: MS-600, produced by Nippon Steel Chemical Co., Ltd.) were dissolved in 55 parts of monochlorobenzene. 1.0 part (as solid) of the silicone type comb shaped graft polymer (Sample a-3) was added to this solution. the resulting liquid was coated on the above charge generation layer and dried by a blast of hot air at 100° C. for 1 hour to form a charge transport layer with a thickness of 16$\mu$. The resulting photosensitive member was referred to as Sample 70.

Using the silicone type comb shaped graft polymers of Sample Nos. b-3-m-3, the respective photosensitive members were fabricated according to the same manner as in the above (Samples 71-82).

A successive copying test of these photosensitive members was performed by repeating the electrophotographic process which comprises a −5.6 KV corona charging, an image exposure, a dry toner developing, transfer of a toner to plain paper and cleaning by a urethane rubber blade. the test was performed under the environmental condition of 32.5° C. and RH 90%. As a result, the stable high quality image was formed up to 5000 successive copying.

EXAMPLE 16

10 parts of lactic casein produced in New Zealand was weighed, dispersed in 90 parts of water, and dissolved by adding 1 part of aqueous ammonia. On the other hand, 3 parts of hydroxypropyl methyl cellulose resin (trade name: Metorose 60 SH 50, produced by Shinetsu Chemical Co., Ltd.) was dissolved in 20 parts of water. Then, the both solutions were mixed to obtain a coating liquid for an underlying layer.

This mixture was coated by the dipping method on an Al cylinder (80$\phi$×300 mm) and dried at 80° C. for 10 minutes to form an underlying layer with a thickness of 10$\mu$.

Next, 12 parts of a pyrazoline compound having the formula:

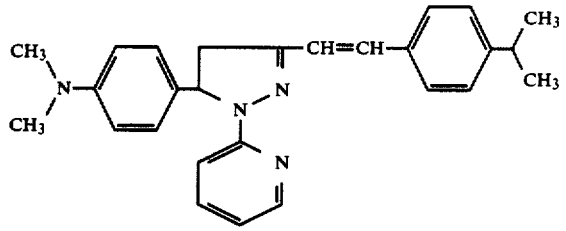

and 10 parts of a polysulfone resin (trade name: Udel P-1700, produced by UCC Corp.) were dissolved in 52 parts of monochlorobenzene. This solution was dip-coated on the above underlying layer and dried at 100° C. for 1 hour to form a charge transport layer with a thickness of 16$\mu$.

10 parts of a bisazo pigment having the formula:

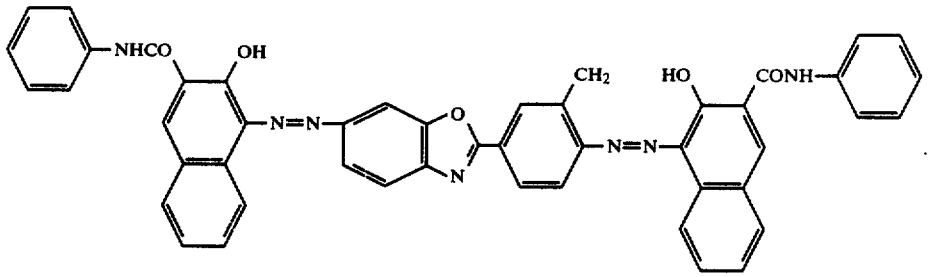

5 parts of poly(vinyl butyral) (trade name: S-LEC BM-S, produced by Sekisui Kagaku K.K.) and 30 parts of butyl acetate were dispersed in a sand mill apparatus containing 1$\phi$ glass beads for 20 hours. This dispersion liquid, to which 40 parts of ethanol and 0.3 part (as solid) of the Sample a-3 silicone type comb shaped graft polymer were added, was dip-coated on the above charge transport layer and dried at 100° C. for 5 minutes to form a charge generation layer with a thickness of 0.15μ. The resulting photosensitive member was referred to as Sample 83.

Using the silicone type comb shaped graft polymers of Sample Nos. b-3-m-3, the respective photosensitive members were fabricated according to the same manner as in the above (Samples 84–95).

A successive copying test of these photosensitive members was performed by repeating the electrophotographic process which comprises a+5.6 KV corona charging, an image exposure, a dry toner developing, transfer of a toner to plain paper and cleaning by a urethane rubber blade and so on. The test was performed under the environmental condition of 32.5° C. and RH 90%. As a result, a stable high quality image was formed up to 3000 successive copying.

EXAMPLE 17

Frictional force between the urethane blade and the surface layer was measured for Sample 67–95. The results are shown in Table 11.

TABLE 11

| Sample No. | Frictional force | Sample No. | Frictional force | Sample No. | Frictional force |
|---|---|---|---|---|---|
| 67 | 0.33 | 78 | 0.26 | 90 | 0.30 |
| 68 | 0.32 | 79 | 0.28 | 91 | 0.28 |
| | | 80 | 0.26 | 92 | 0.30 |
| 69 | 0.31 | 81 | 0.29 | 93 | 0.27 |
| | | 82 | 0.28 | 94 | 0.25 |
| 70 | 0.26 | | | 95 | 0.27 |
| 71 | 0.22 | 83 | 0.29 | | |
| 72 | 0.28 | 84 | 0.25 | | |
| 73 | 0.23 | 85 | 0.25 | | |
| 74 | 0.27 | 86 | 0.27 | | |
| 75 | 0.26 | 87 | 0.25 | | |
| 76 | 0.30 | 88 | 0.28 | | |
| 77 | 0.27 | 89 | 0.27 | | |

*Frictional force is a relative value in the case where the frictional force of Sample 19 is regarded as standard value 1.

EXAMPLE 18

There were measured the dark portion potential ($V_D$) and the light portion potential ($V_L$) at the initial stage and after repeated use of 3000 times performed by the same electrophotographic process as and under the same environmental condition as in Examples 13, 14, 15 and 16 for observing the potential charge between the potential at the initial stage and that after repeated use of 3000 times. A part of the results is shown in Table 12.

TABLE 12

| Sample | Initial stage | | After 3000 successive copying | |
|---|---|---|---|---|
| No. | $V_D$(v) | $V_L$(v) | $V_D$(v) | $V_L$(v) |
| 67 | −840 | −160 | −740 | −180 |
| 69 | +910 | +190 | +860 | +220 |
| 70 | −840 | −160 | −800 | −200 |
| 83 | +800 | +200 | +780 | +240 |

EXAMPLE 19

An underlying layer and a charge generation layer were formed on an Al cylinder according to the same manner as in Example 3.

Next, 10 parts of the hydrazone compound having the formula:

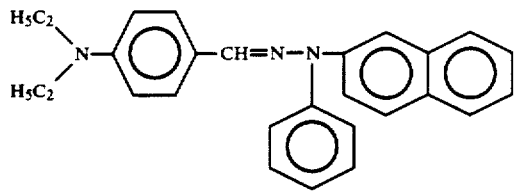

and 10 parts of polycarbonate resin were dissolved in 100 parts of 1,2-dichloroethane. To this liquid, 0.2 parts (as solid) of the silicone type comb shaped graft polymer of Sample No. a-2 was added. This solution was coated on the above charge generation layer and dried by a blast of hot air at 100° C. for one hour to form a charge transport layer with a thickness of 16μ. The resulting photosensitive member was referred to as Sample 96.

A successive copying test of this photosensitive member was performed by repeating 30000 times an electrophotographic process which comprises a −5.5 KV corona charging, an image exposure, a dry toner developing, transfer of a toner to plain paper and cleaning by an urethane rubber blade. The test was performed under the environmental condition of 32.5° C. and RH 90%. As a result, a stable high quality image was formed up to 30000 successive copying by Sample 96.

The polycarbonate resin used was prepared as follows. 0.15 mole of bisphenols, 0.353 g of phenol, 16.8 g of NaOH and 238 ml of water were poured into a separable flask (500 ml) provided with a stirrer, and after thermally dissolved at 50° C., cooled at 25° C. Then, 147 ml of methylene chloride was added thereto.

Next, 19.1 g of phosgene was mixed with the thus prepared solution over 60 minutes at 25° C. while stirring. Then, 0.0342 g of trimethylbenzyl ammonium chloride, 4.5 g of NaOH and 30 ml of water were added, the polymerization was carried out at 25° C. for 4.5 hours while stirring. After the polymerization was complete, the reaction mixture was diluted with 360 ml of methylene chloride and made weakly acidic with HCl while stirring. Then, the methylene chloride phase was separated and washed with water 5 times. The methylene chloride solution of the polymer was added to methanol for solidifying, and dried at 100° C. for 15 hours under 1 mm. Hg to obtain a white polymer.

In this Example, as to the comparative sample fabricated similarly without adding the silicone type comb shaped graft polymer, image running occurred at about 500 successive copying.

EXAMPLE 20

An underlying layer and a charge generation layer were formed on an Al cylinder according to the same manner as in Example 3.

Next, 10 parts of a hydrazone compound having the formula:

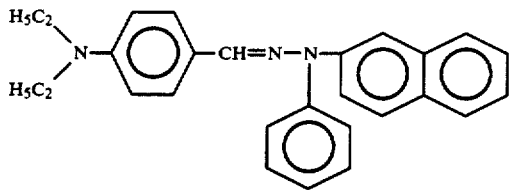

and 10 parts of polyarylate resin were dissolved in 100 parts of dichloromethane. To this solution, 0.2 part (as solid) of the silicone type comb shaped graft polymer (Sample No. a-3) was added. The resulting solution was coated on the above charge generation layer and dried by a blast of hot air at 100° C. for one hour to form a charge transport layer with a thickness of 16μ. The resulting photosensitive member was referred to as Sample 97.

The photosensitive member as a comparative sample to which the silicone type comb shaped graft polymer was not added was fabricated according to the same manner as in the above, and compared with Sample 97.

A successive copying test of these photosensitive members was performed by repeating 30,000 times the electrophotographic process which comprises a −5.5 KV corona charging, an image exposure, a dry toner developing, transfer of a toner to plain paper and cleaning by an urethane rubber blade. The test was performed under the environmental condition of 32.5° C. and RH 90%.

The results were as follows:

Sample 97: A stable high quality image was formed up to 30000 successive copying.

Comparative Sample: Image running occurred at about 500 successive copying.

The polyarylate resin used in this Example was prepared as follows. 1.0 mole of bisphenols was dissolved in 1 mole aqueous solution of sodium hydroxide, and a surface active agent was added thereto. The solution in which 1.0 mole of terephthalic acid chloride was dissolved in chloroform was added to the resulting solution while stirring. After stirring, the resulting emulsion was poured into acetone to deposit a polymer. The polymer in acetone was washed thoroughly with water, filtrated and dried thermally. Thereby, a white polymer was obtained.

What is claimed is:

1. An electrophotographic image holding member which comprises a surface layer containing a silicone type comb shaped graft polymer having a silicone portion at the side chain.

2. The image holding member according to claim 1 in which the silicone type comb shaped graft polymer is produced by copolymerization of a compound having a copolymerizable functional group with a modified silicone which is a condensation reaction product of a silicone selected from the following formulas (I) and (II) and a silicone selected from the following formulas (III), (IV) and (V):

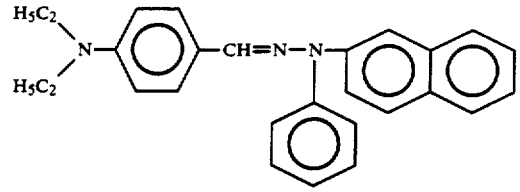

where $R_1$–$R_5$ are selected from alkyl and aryl, and n is an average degree of polymerization;

$$HO\text{-}\left(\overset{R_6}{\underset{R_7}{Si}}O\right)_n\text{-}H \qquad \text{(II)}$$

where $R_6$ and $R_7$ are selected from alkyl and aryl, and n is an average degree of polymerization;

$$\overset{R_8}{\underset{R_9}{C}}=\overset{R_{10}}{C}-A-Si-(R_{11})_{3-n}X_n \qquad \text{(III)}$$

where $R_8$, $R_9$ and $R_{10}$ are selected from hydrogen, halogen, alkyl and aryl, $R_{11}$ is selected from alkyl and aryl, A is arylene, X is selected from halogen and alkoxy, and n is an integer of 1–3;

$$\overset{R_{12}}{\underset{R_{13}}{C}}=\overset{R_{14}}{C}-Si-(R_{15})_{3-n}X_n \qquad \text{(IV)}$$

where $R_{12}$, $R_{13}$, and $R_{14}$ are selected from hydrogen, halogen, alkyl and aryl, $R_{15}$ is selected from alkyl and aryl, X is selected from halogen and alkoxy, and n is an integer of 1–3;

$$CH_2=\overset{R_{16}}{C}-\underset{\underset{O}{\|}}{C}-O\text{-}\left(CH_2\right)_l\text{-}\left(O\right)_m\text{-}C_3H_6-Si(R_{17})_{3-n}X_n \qquad \text{(V)}$$

where $R_{16}$ is selected from hydrogen, alkyl, aryl and aralkyl, $R_{17}$ is selected from alkyl and aryl, X is selected from halogen and alkoxy, m is 0 or 1, 1 is an integer of 0–2 when m=0, 1 is 2 when m=1, and n is an integer of 1–3.

3. The image holding member according to claim 1 in which the content of the graft polymer in the surface layer of the image holding member is 0.01–10% by weight.

4. The image holding member according to claim 1 in which the surface layer is provided on a photoconductive layer.

5. The image holding member according to claim 1 in which the surface layer itself is a photoconductive layer.

6. The image holding member according to claim 5 in which the photoconductive layer contains a photoconductive polymer.

7. The image holding member according to claim 5 in which the photoconductive layer is composed of photoconductive particles dispersed or dissolved in a binder.

8. The image holding member according to claim 5 in which the photoconductive layer is constituted of a charge generation layer containing a charge generating material and a charge transport layer containing a charge transporting material.

9. The image holding member according to claim 2 in which the content of a modified silicone in the silicone type comb shaped graft polymer is 5–90% by weight.

10. The image holding member according to claim 9 in which the content of a modified silicone is 10–70% by weight.

11. The image holding member according to claim 2 in which the compound having a polymerizable functional group is a polymerizable monomer not having a silicon atom.

12. The image holding member according to claim 2 in which the compound having a polymerizable functional group is a macromonomer composed of a low molecular weight polymer having a polymerizable functional group at the end portion.

* * * * *

UNITED STATES PATENT AND TRADEMARK OFFICE

CERTIFICATE OF CORRECTION

PATENT NO. : 4,716,091

DATED : December 29, 1987

INVENTOR(S) : TOSHIYUKI YOSHIHARA, ET AL.

It is certified that error appears in the above-identified patent and that said Letters Patent is hereby corrected as shown below:

AT [57] IN THE ABSTRACT

Line 2, "comb shaped should read --comb-shaped--.

COLUMN 20

Form 173, "$OCH_3$" should read --$CH_3$--.

COLUMN 22

Form 200, "

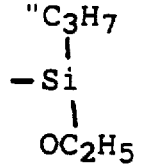

" should read --

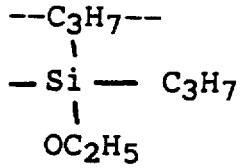

--

COLUMN 42

Lines 49-50, "300 methacrylate" should read --300 methacrylate --

70 30 70 30

COLUMN 49

Line 57, "comb shaped" should read --comb-shaped--.
Line 61, "comb shaped" should read --comb-shaped--.

UNITED STATES PATENT AND TRADEMARK OFFICE

CERTIFICATE OF CORRECTION

PATENT NO. : 4,716,091

DATED : December 29, 1987

INVENTOR(S) : TOSHIYUKI YOSHIHARA, ET AL.

It is certified that error appears in the above-identified patent and that said Letters Patent is hereby corrected as shown below:

COLUMN 50

Lines 1-9, "

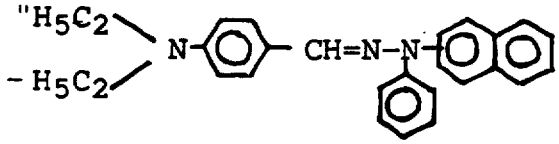

"

should read

--

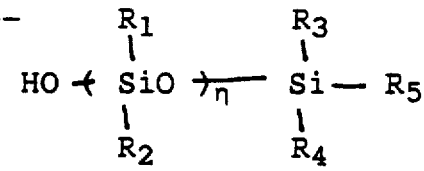

--

COLUMN 51

Line 13, "comb shaped" should read --comb-shaped--.

Signed and Sealed this

Fifth Day of July, 1988

*Attest:*

*Attesting Officer*

DONALD J. QUIGG

*Commissioner of Patents and Trademarks*